US006668795B1

(12) United States Patent
Shimada

(10) Patent No.: US 6,668,795 B1
(45) Date of Patent: Dec. 30, 2003

(54) CONTROLLER WITH FEED-BACK SYSTEM

(75) Inventor: Kousaku Shimada, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/576,862

(22) Filed: May 22, 2000

(30) Foreign Application Priority Data

May 21, 1999 (JP) ..... 11-141775

(51) Int. Cl.[7] ..... F02D 41/22

(52) U.S. Cl. ..... 123/350; 123/396; 123/690; 123/479; 701/114

(58) Field of Search ..... 123/339.15, 350, 123/359, 396, 688, 690, 479; 701/107, 114

(56) References Cited

U.S. PATENT DOCUMENTS 4,534,328 A * 8/1985 Fischer et al. ..... 123/359
5,282,449 A * 2/1994 Takahashi et al. ..... 123/350
6,032,644 A * 3/2000 Bederna et al. ..... 123/339.15

FOREIGN PATENT DOCUMENTS

JP 57110731 7/1982
JP A-10-238394 8/1998
JP A-10-212989 11/1998
JP 10212989 5/1999
JP 10238394 12/1999

OTHER PUBLICATIONS

English Translation of Japanese Office Action dated Jul. 27, 2001.

* cited by examiner

*Primary Examiner*—Andrew M. Dolinar
(74) *Attorney, Agent, or Firm*—Crowell & Moring LLP

(57) ABSTRACT

In an engine controller with a feed back control system, an instruction signal for controlling an engine condition adjusting device is determined on the basis of a comparison between an input signal corresponding to a desired engine condition and an actual engine condition signal when the engine controller, the engine condition adjusting device and a sensor for generating the actual engine condition signal operates normally, and is determined on the basis of the input signal while preventing the instruction signal from being determined on the basis of the comparison between the input signal and the actual engine condition signal when an abnormality of at least one of the engine controller, the engine condition adjusting device and the sensor is detected.

40 Claims, 20 Drawing Sheets

FIG. 8

| | H/W CHECKING OK (#xHWNG=0) | | | H/W CHECKING (#xHWNG=1) | | |
|---|---|---|---|---|---|---|
| | TPS.TCM CHECKING OK | CA | NG | TPS.TCM CHECKING OK | CA | NG |
| APS CHECKING OK | A CONTROL(NORMAL) FTERMODE=0 | B CONTROL FTERMODE=1 | E CONTROL FTERMODE=4 | C CONTROL FTERMODE=2 | D CONTROL FTERMODE=3 | F CONTROL FTERMODE=5 |
| CA | B CONTROL FTERMODE=1 | B CONTROL FTERMODE=1 | E CONTROL FTERMODE=4 | D CONTROL FTERMODE=3 | D CONTROL FTERMODE=3 | F CONTROL FTERMODE=5 |
| NG | E CONTROL FTERMODE=4 | E CONTROL FTERMODE=4 | E CONTROL FTERMODE=4 | F CONTROL FTERMODE=5 | F CONTROL FTERMODE=5 | F CONTROL FTERMODE=5 |

FIG. 9

| | BASIC CONTROL | FUEL INJECTION RATE LIMITATION(TP CALCULATION) | THROTTL OPENING DEGREE | LEAN COMBUSTION | THROTTLE MOTOR RELAY |
|---|---|---|---|---|---|
| A CONTROL(NORMAL) FTERMODE=0 | FUEL INJECTION RATE PREDETERMINATION | DATUM TPM DETERMINATION ON MAP | TP FEED BACK CONTROL #FSENKSW=1 | ALLOW #FSLEANOK=1 | ON #FETCRLY=1 |
| B CONTROL FTERMODE=1 | FUEL INJECTION RATE PREDETERMINATION | DATUM TPM DETERMINATION ON MAP (SETTING UPPER LIMIT) | TP FEED BACK CONTROL #FSENKSW=1 | RREVENT #FSLEANOK=0 | ON #FETCRLY=1 |
| C CONTROL FTERMODE=2 | FUEL ·AIR F/F CONTROL | DATUM TPM DETERMINATION ON MAP (SETTING UPPER LIMIT) | APS: TPS=1:1 CONTROL #FSENKSW=0 | RREVENT #FSLEANOK=0 | ON #FETCRLY=1 |
| D CONTROL FTERMODE=3 | FUEL ·AIR F/F CONTROL | DATUM TPM DETERMINATION ON MAP (SETTING UPPER LIMIT) | APS: TPS=1:1 CONTROL (SETTING UPPER LIMIT) #FSENKSW=0 | RREVENT #FSLEANOK=0 | ON #FETCRLY=1 |
| E CONTROL FTERMODE=4 | INTAKE AIR FLOW RATE PREDETERMINATION | FULE INJECTION RATE CALCULATION FROM MEASURED QA | DEFAULT OPENING DEGREE FIXING #FSENKSW=0 | RREVENT #FSLEANOK=0 | ON #FETCRLY=0 |
| F CONTROL FTERMODE=5 | FUEL ·AIR FIXING CONTROL | FIXING FUEL INJECTION RATE (REFER TO 2.12) | DEFAULT OPENING DEGREE FIXING #FSENKSW=0 | RREVENT #FSLEANOK=0 | OFF #FETCRLY=0 |

FIG. 10

| CONDITION | OK | CA | NG |
|---|---|---|---|
| (a) #THVHNG=1 OPEN BREAKDOWN OF THROTTLE SENSOR 2 | × | ○ | — |
| (b) #THVHNG=1 SHORT BREAKDOWN OF THROTTLE SENSOR 2 | × | ○ | — |
| (c) #TPS10R=1 TPS1 VOLTAGE CONFIRMED ABNORMALITY | × | ○ OR | ○ AND |
| (d) #TPS20R=1 TPS2 VOLTAGE CONFIRMED ABNORMALITY | × | ○ | ○ |
| (e) #TPS12SO=1 TPS1-2 INTERRELATION CONFIRMED | × | ○ | — |
| (f) #TCMACT=1 THROTTLE VALVE OPERATION ABNORMALITY | × | × | — |
| (g) #TCMRSP=1 RETURN SPRING ABNORMALITY | × | × | — |
| (h) #TCMSCI=1 COMMUNICATION ABNORMALITY | × | × | — |

○:CONDITION ×:CONDITION UNFULFILLED

FIG. 11

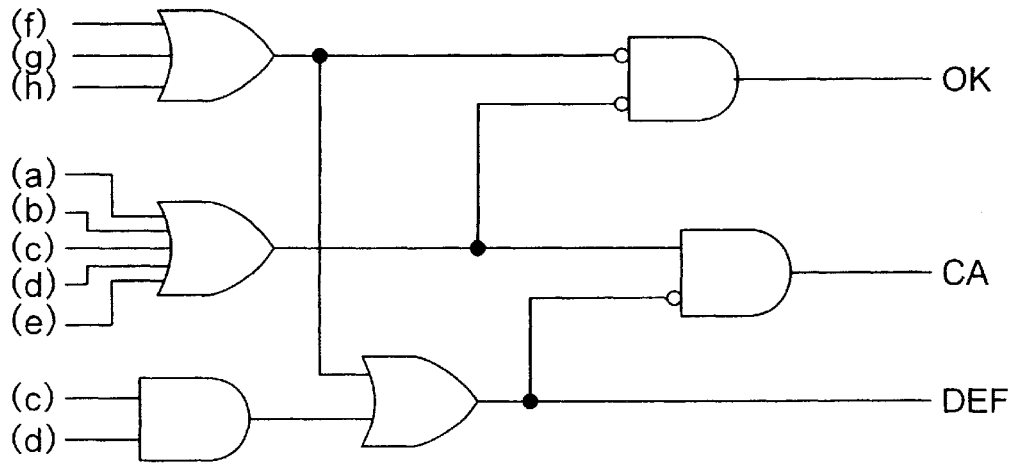

FIG. 12

| | APS1-2 INTERRELATION NORMAL APS12S0=0 | APS1-2 INTERRELATION NORMAL APS12S0=1 |
|---|---|---|
| APS1 VOLTAGE NORMAL APS10R=0<br>APS2 VOLTAGE NORMAL APS20R=0 | APS[OK] | APS[CA] |
| APS1 VOLTAGE NORMAL APS10R=0<br>APS2 VOLTAGE ABNORMAL APS20R=1 | APS[CA] | APS[CA] |
| APS1 VOLTAGE ABNORMAL APS10R=1<br>APS2 VOLTAGE NORMAL APS20R=0 | APS[CA] | APS[CA] |
| APS1 VOLTAGE ABNORMAL APS10R=1<br>APS2 VOLTAGE ABNORMAL APS20R=1 | APS[NG] | APS[NG] |

FIG. 15
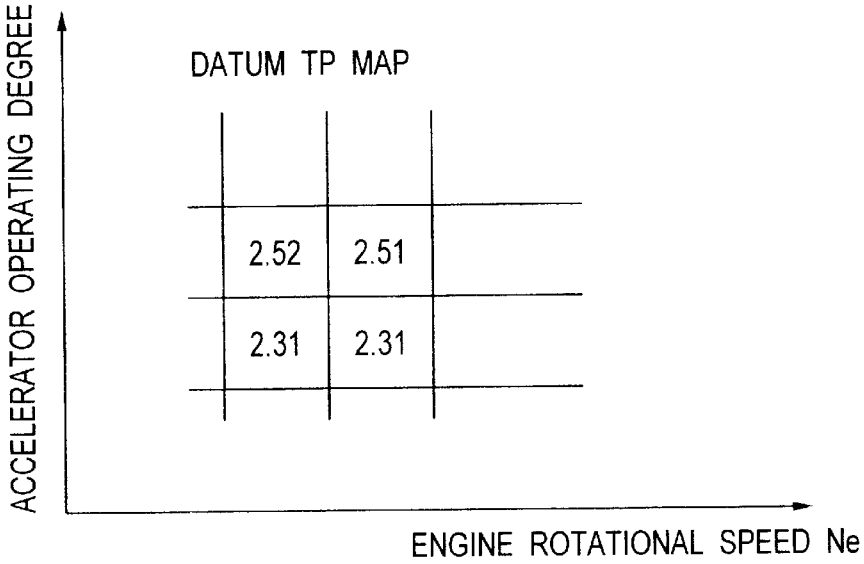
FIG. 16
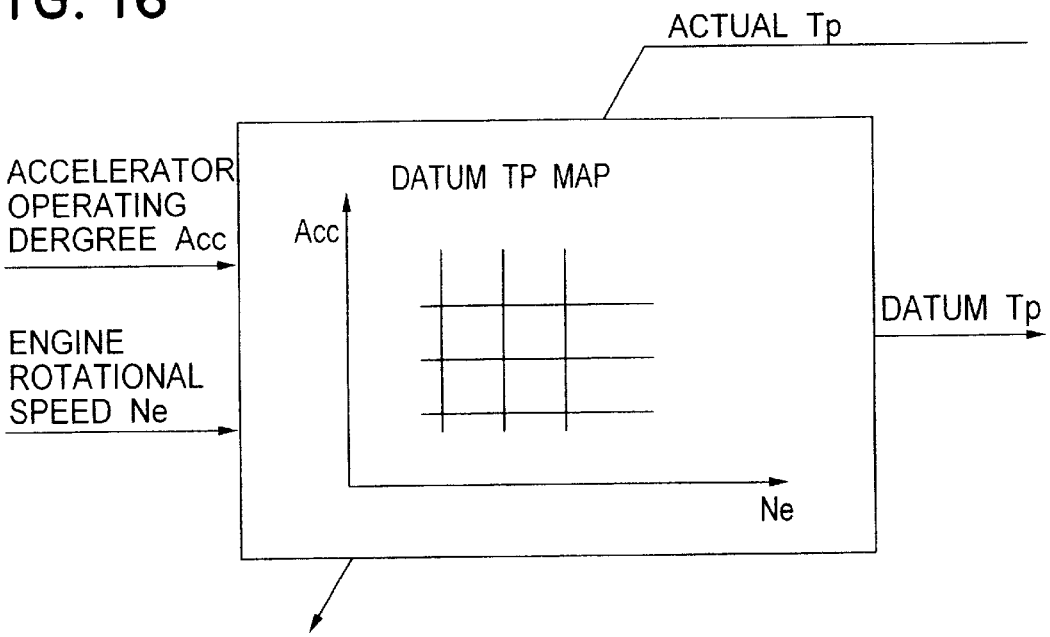
FIG. 17
DATUM TP TABULE
| ACCELERATOR OPERATING DEGREE Acc(deg) | ··· | 4 | 8 | ··· |
|---|---|---|---|---|
| DATUM Tp(ms) | ··· | 2.31 | 2.52 | ··· |

CONTROLLER WITH FEED-BACK SYSTEM

BACKGROUND OF THE INVENTION AND RELATED ART STATEMENT

The present invention relates to an engine controller for controlling an engine operation actuator (for example, a throttle, a fuel injector or the like) to generate an output torque and power in consideration of an actual engine condition (for example, an output torque, an output power (estimated from output torque and engine rotational speed), an intake air mass flow rate, an opening degree of throttle or the like).

JP-A-10-212989 discloses an engine controller in which an operation degree of an engine operation actuator is adjusted in accordance with an actual engine condition and a circumferential condition of the engine.

JP-A-10-238394 discloses how to detect a trouble of throttle.

OBJECT AND SUMMARY OF THE INVENTION

An object of the present invention is to provide an apparatus (for example, engine) controller with a feed-back control system, in which controller an output of the apparatus is safely controllable when a trouble of an element used for the controller occurs.

In an engine controller for controlling an engine condition adjusting device in an engine in consideration of an actual engine condition measured by an engine condition measuring sensor, comprising, an interface device for generating an input signal corresponding to a desired engine condition, and an instruction signal generator for determining an instruction signal to be input to the engine condition adjusting device for controlling an operation degree of the engine condition adjusting device on the basis of a comparison between the input signal and an actual engine condition signal corresponding to the actual engine condition so that a difference between the desired engine condition and the measured actual engine condition is decreased, since the instruction signal for controlling the engine condition adjusting device is determined on the basis of the comparison between the input signal and the actual engine condition signal when normalities of the interface device, the engine condition changing device and the engine condition measuring sensor are detected, and is determined on the basis of the input signal while preventing the instruction signal from being determined on the basis of the comparison between the input signal and the actual engine condition signal when an abnormality of at least one of the interface device, the engine condition changing device and the engine condition measuring sensor is detected, a degree of an excessive or uncontrollable engine operation or output caused by the troubled at least one of the interface device, the engine condition changing device and the engine condition measuring sensor is kept small, or an undesirable or uncontrollable engine operation or output is prevented from being enlarged by a multiplicative trouble effect among the interface device, the engine condition changing device and the engine condition measuring sensor by returning to a simple control based on the input signal without the comparison between the input signal and the actual engine condition signal.

The interface device may generate the input signal corresponding to a desired engine output power ordered from an accelerator outside of the engine controller. The instruction signal for controlling the engine condition adjusting device may be determined on the basis of the comparison between the input signal generated by the interface device and the actual engine condition signal when the normalities of the interface device, the engine condition changing device and the engine condition measuring sensor are detected, and is determined on the basis of the input signal corresponding to the desired engine output power ordered from the accelerator while preventing the instruction signal from being determined on the basis of the comparison between the input signal generated by the interface device and the actual engine condition signal when the abnormality of the at least one of the interface device, the engine condition changing device and the engine condition measuring sensor is detected.

The interface device may generate the input signal corresponding to a desired engine output power, a desired engine output torque, a desired injection rate of a fuel to be injected into the engine or a desired mass flow rate of an intake air to be taken into the engine, as the desired engine condition. The input signal corresponding to the desired mass flow rate of the intake air to be taken into the engine may be modified in accordance with a desired air-fuel ratio.

The instruction signal generator may determine the instruction signal for controlling an opening degree of an electrically controlled throttle as the engine condition adjusting device. The instruction signal may be modified in accordance with a desired air-fuel ratio. The instruction signal generator determines the instruction signal for controlling an injection rate of a fuel to be injected into the engine.

The actual engine condition signal may correspond to an actual mass flow rate of an intake air to be taken into the engine, an actual engine output torque or an actual engine output power (which may be estimated from output torque and engine rotational speed). The actual fuel injection rate may be estimated from the actual engine output torque or the actual engine output power per engine rotation. The actual mass flow rate of the intake air to be taken into the engine corresponds to the actual engine output power when the air-fuel ratio is kept at a certain degree, so that the actual engine output power is estimated from the actual mass flow rate of the intake air. The desired injection rate of the fuel to be injected into the engine corresponds to the desired engine output power or torque. The desired injection rate of the fuel per engine combustion cycle or engine output rotational speed corresponds to the desired engine output power per engine combustion cycle or engine output rotational speed, or the desired engine output torque.

The instruction signal for controlling the engine condition adjusting device may be determined on the basis of the comparison between the input signal corresponding to the desired engine output torque and the actual engine condition signal corresponding to the actual engine output torque when a normality of a torque sensor of the engine condition measuring sensor is detected, and be determined on the basis of the input signal corresponding to the desired engine output power (ordered by, for example, an accelerator outside of the controller) while preventing the instruction signal from being determined on the basis of the comparison between the input signal corresponding to the desired engine output torque and the actual engine condition signal corresponding to the actual engine output torque when the abnormality of the engine condition measuring sensor for measuring the actual engine output torque is detected.

The interface device may generate the input signal corresponding to the desired engine output power or torque on the basis of an engine output rotational speed and an instructed engine output power instructed from an accelerator outside of the engine controller.

When at least of the engine condition changing device and the engine condition measuring sensor includes a communication path through which an information is transmitted with respect to the engine controller, the abnormality of the at least one of the engine condition changing device and the engine condition measuring sensor may be the abnormality of the communication path. When a throttle of the engine condition changing device for controlling the mass flow rate of the intake air to be taken into the engine includes at least one sensor for generating an output signal corresponding to an opening degree of the throttle, the abnormality of the engine condition changing device may be an abnormality of the sensor. When the interface device generates the input signal in accordance with an output signal of at least one sensor outside of the engine controller for measuring an operated degree of an accelerator outside of the engine controller, and the operated degree of the accelerator corresponds to an ordered engine output power ordered by the accelerator, the abnormality of the interface device may be an abnormality of the sensor.

The operation degree of the engine condition adjusting device may be an opening degree of the throttle for adjusting the mass flow rate of the intake air to be taken into the engine, or the injection rate of the fuel to be injected into the engine.

At least one of a prevention of forming a lean fuel air mixture, a decrease of an upper limit of an injection rate of a fuel to be injected into the engine, a decrease of an upper limit of an opening degree of a throttle as the engine condition adjusting device, a close of the throttle and a prevention of supplying an electric current to the throttle may be carried out in response to the abnormality of the at least one of the interface device, the engine condition changing device and the engine condition measuring sensor is detected. Which is selected to be carried out from the prevention of forming the lean fuel air mixture, the decrease of the upper limit of the injection rate of the fuel to be injected into the engine, the decrease of the upper limit of the opening degree of the throttle, the close of the throttle and the prevention of supplying the electric current to the throttle may be determined in accordance with a degree of the abnormality of the at least one of the interface device, the engine condition changing device and the engine condition measuring sensor.

The abnormality of the sensor may detected when a magnitude of the output signal of the sensor is in a range other than a predetermined acceptable range. The abnormality of the sensor may be detected when a difference between a plurality of the output signals of the sensors is more than a predetermined acceptable level. The abnormality of the engine condition changing device may be detected when a difference between an actual opening degree of the throttle of the engine condition changing device and a desired opening degree of the throttle is kept more than a predetermined acceptable level for a time period more than a predetermined acceptable time period. The abnormality of the engine condition changing device may be detected when an electric current supplied to an electrically controlled throttle of the engine condition changing device is kept more than a predetermined acceptable level for a time period more than a predetermined acceptable time period. The abnormality of the engine condition measuring sensor may be detected when a magnitude of the actual engine condition signal corresponding to the actual mass flow rate of the intake air to be taken into the engine is in a range other than a predetermined acceptable range. The abnormality of the engine condition measuring sensor may be detected when a difference between the actual engine condition signals which are generated by a plurality of the engine condition measuring sensors and correspond respectively to actual mass flow rates of the intake air to be taken into the engine is more than a predetermined acceptable level. The abnormality of the engine condition measuring sensor may be detected when a difference between the actual mass flow rate of the intake air to be taken into the engine measured by the engine condition measuring sensor and a mass flow rate of the intake air to be taken into the engine estimated from the engine output rotational speed and the opening degree of the throttle of the engine condition changing device is more than a predetermined acceptable level. The abnormality of the engine condition measuring sensor may be detected when a magnitude of the actual engine condition signal corresponding to the actual engine condition is in a range other than a predetermined acceptable range. The abnormality of the engine condition changing device may be detected when a difference between the input signal and the actual engine condition signal is more than a predetermined level.

The desired condition corresponding to the input signal compared to the actual engine condition signal to determined the instruction signal when the normalities of the interface device, the engine condition changing device and the engine condition measuring sensor are detected may be different from the desired condition corresponding to the input signal on the basis of which the instruction signal is determined when the abnormality of the at least one of the interface device, the engine condition changing device and the engine condition measuring sensor is detected. The desired condition corresponding to the input signal compared to the actual engine condition signal to determined the instruction signal when the normalities of the interface device, the engine condition changing device and the engine condition measuring sensor are detected may be equal to the desired condition corresponding to the input signal on the basis of which the instruction signal is determined when the abnormality of the at least one of the interface device, the engine condition changing device and the engine condition measuring sensor is detected.

In a controller for controlling an apparatus condition adjusting device in an apparatus in consideration of an actual apparatus condition measured by an apparatus condition measuring sensor, comprising, an interface device for generating an input signal corresponding to a desired apparatus condition, and an instruction signal generator for determining an instruction signal to be input to the engine condition adjusting device for controlling an operation degree of the apparatus condition adjusting device on the basis of a comparison between the input signal and an actual apparatus condition signal corresponding to the actual apparatus condition so that a difference between the desired apparatus condition and the measured actual apparatus condition is minimized, since the instruction signal for controlling the apparatus condition adjusting device is determined on the basis of the comparison between the input signal and the actual apparatus condition signal when a normality of at least one of the interface device, the apparatus condition changing device and the apparatus condition measuring sensor is detected, and is determined on the basis of the input signal while preventing the instruction signal from being determined on the basis of the comparison between the input signal and the actual apparatus condition signal when an abnormality of at least one of the interface device, the apparatus condition changing device and the apparatus condition measuring sensor is detected, a degree of an excessive or uncontrollable apparatus operation or output caused by the troubled at least one of the interface device, the apparatus condition changing device and the apparatus condition measuring sensor is kept small, or an undesirable or uncontrollable apparatus operation or output is prevented from being enlarged by a multiplicative trouble effect among the interface device, the apparatus condition changing device and the apparatus condition measuring sensor by returning to a simple control based on the input signal without the comparison between the input signal and the actual apparatus condition signal.

BRIEF DESCRIPTION OF THE DRAWINGS

FIG. 8 is a table for evaluating the abnormality of the feed-back system of the engine controller of the invention.

FIG. 9 is a table for evaluating the abnormality of the feed-back system of the engine controller of the invention.

FIG. 10 is a table for evaluating the abnormality of the feed-back system of the engine controller of the invention.

FIG. 11 is a diagram showing a logic for evaluating the abnormality of the feed-back system of the engine controller of the invention.

FIG. 12 is a table for evaluating the abnormality of the feed-back system of the engine controller of the invention.

FIG. 15 is a table showing a relationship among the engine output rotational speed, an operated or opened degree of an accelerator, and an desired output power (corresponding to an desired fuel injection rate and/or a desired mass flow rate of an air to be supplied into the engine under a certain fuel-air ratio).

FIG. 16 is a block diagram showing a control unit containing the table of FIG. 15.

FIG. 17 is a table showing a relationship between the operated or opened degree of an accelerator, and the desired output power (corresponding to the desired fuel injection rate and/or the desired mass flow rate of an air to be supplied into the engine under the certain fuel-air ratio).

DETAILED DESCRIPTION OF PREFERRED EMBODIMENTS

In the following description, a fuel injection rate corresponds to an actual fuel rate, a desired fuel injection rate, a desired mass flow rate of intake air, an actual mass flow rate of intake air, a desired output torque, an actual output torque and a desired output power per engine rotation, because when a certain (for example, Stoichiometric) fuel-air ratio is imaginarily fixedly set in a controller, the mass flow rate of intake air, the output torque and the output power per engine rotation is convertible from the fuel injection rate, and the mass flow rate of intake air under the certain (for example, Stoichiometric) fuel-air ratio can be converted to the mass flow rate of intake air under a desired fuel-air ratio by changing in accordance with a ratio between the certain fuel-air ratio and the desired fuel-air ratio the fuel injection rate corresponding to the desired mass flow rate of intake air under certain fuel-air ratio to a substitute fuel injection rate corresponding to the desired mass flow rate of intake air under the desired fuel-air ratio.

Figure 1:
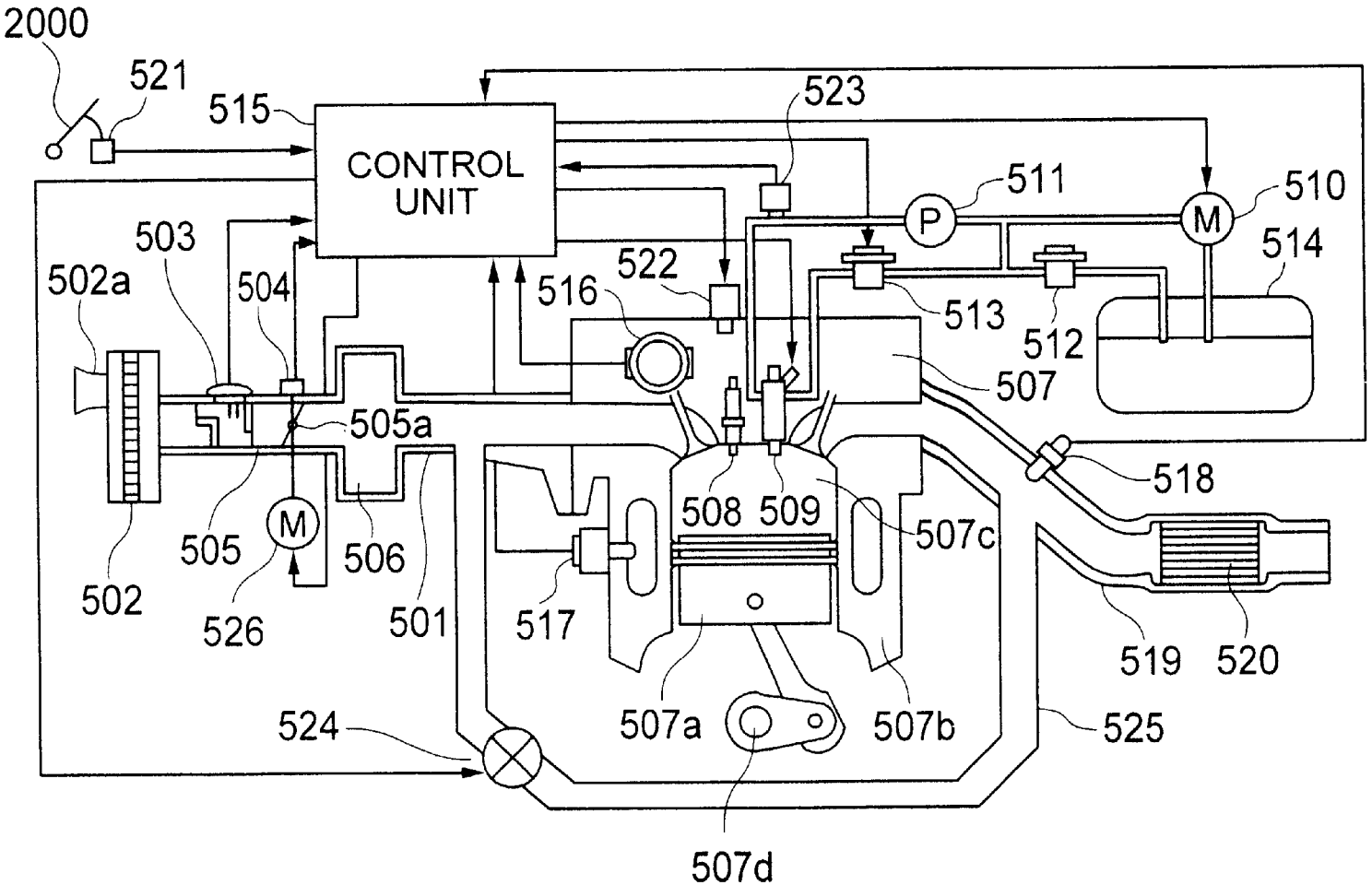
FIG. 1 is a schematic view showing an engine with an engine controller of the invention.
Figure 2:
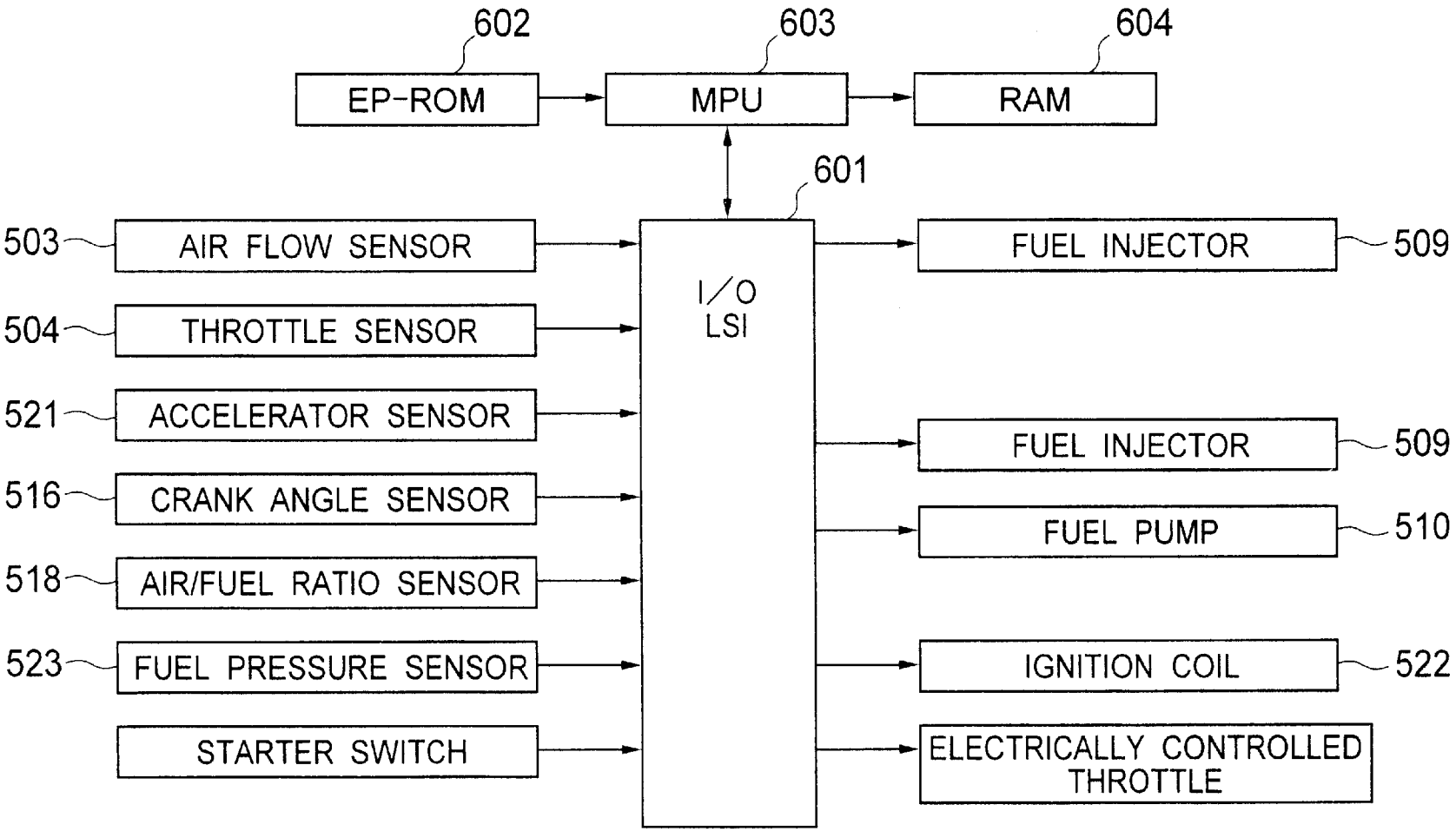
FIG. 2 is a schematic view showing the engine controller of the invention.

As shown in FIG. 1, an intake air to be supplied into an engine 507 flows into a collector 506 from an inlet 502*a* of an air cleaner 502 through a mass flow meter 503 for measuring a mass flow rate of intake air as the claimed engine condition measuring sensor and a throttle body 505 for controlling the mass flow rate of intake air as the claimed engine condition adjusting device containing a throttle valve 505*a*. The intake air is distributed from the collector 506 to combustion chambers 507*c* in combustion cylinders 507*b* through intake air tubes 501 connected to the combustion cylinders 507*b*.

A pressure of fuel is pressurized by a fuel pump 510 and regulated by a pressure regulator 512 at, for example, about 3 kg/cm$^2$ by a fuel pump 510, and subsequently further pressurized by a fuel pump 511 and regulated by a pressure regulator 513 at, for example, about 30 kg/cm$^2$ so that the pressurized fuel is fed from a fuel tank 514 to a fuel line to which fuel injectors 509 are connected. The fuel injected by the fuel injectors 509 into the combustion chambers 507*c* is ignited by ignition plugs 508 energized by a high-voltage ignition signal generated by an ignition coil 522.

The mass flow meter 503 generates a signal corresponding to the mass flow rate of intake air as the claimed actual engine condition, and the signal is input to a control unit 515 as the claimed controller. At least one throttle sensor (preferably two throttle sensors) 504 mounted on the throttle body 505 generates a signal corresponding to an opening degree of the throttle valve 505*a*, and the signal is input to the control unit 515.

A bypath tube 525 extending between an intake air tube 501 and an exhaust air tube 519 includes an EGR valve 524 for controlling a flow rate of an exhaust gas returning from the exhaust air tube 519 to the intake air tube 501. A crank angle sensor 516 connected to an engine cam shaft (not shown) generates a signal REF corresponding to a phase of a crank shaft 507*d* (a combustion-expansion and exhaust phase and an air-intake and air compression phase) and a signal POS corresponding to an angular position of the crank shaft 507*d*, and the signals are input to the control unit 515.

An A/F sensor 518 mounted in the exhaust air tube 519 before a catalyst 520 generates a signal corresponding to a concentration of a component (for example, fuel) in the exhaust gas, and the signal is input to the control unit 515. The control unit 515 includes an MPU 603 as the claimed instruction signal generator, a ROM 602, a RAM 604 and an I/O interface LSI 601 as the claimed interface device for receiving various signals including a signal corresponding to a desired engine condition (for example, an engine output power or torque), a signal corresponding to the actual engine condition, a signal generated by each of the sensors above described and below described, and so forth. The control unit 515 treats the signals to generate instruction signals for controlling the throttle valve 505, the fuel injector 509, the ignition coil 522 and so forth.

Figure 3:
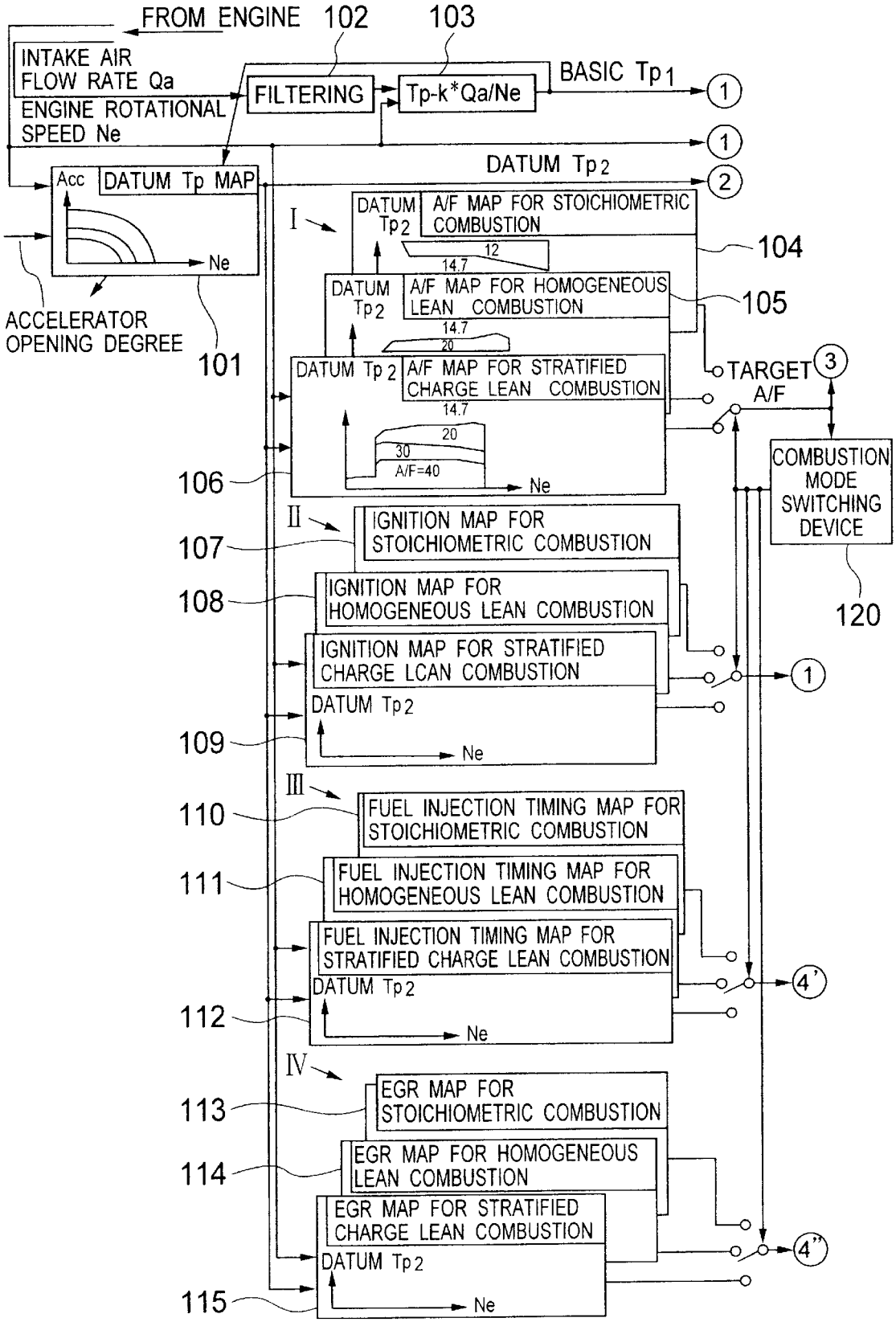
FIG. 3 is a schematic view showing control diagrams and control data flow processes in the engine controller of the invention.
Figure 4:
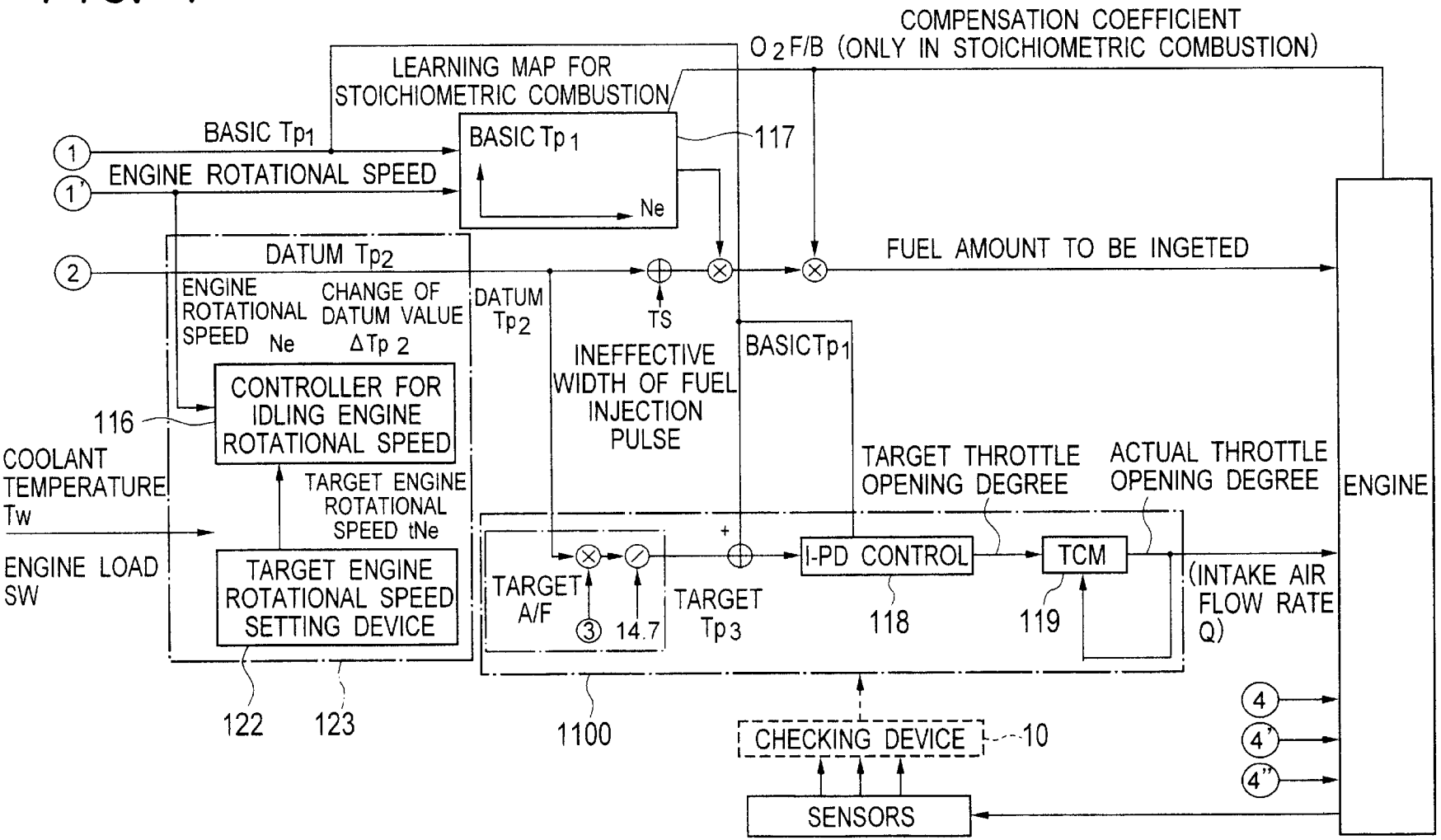
FIG. 4 is a schematic view showing control diagrams and control data flow processes in the engine controller of the invention.

As shown in FIGS. 3 and 4, the mass flow rate of intake air Qa measured by the mass flow meter 503 is converted to a basic fuel injection rate or basic fuel injection pulse width $Tp_1$ under the certain (preferably, Stoichiometric) fuel-air ratio combustion along a formula ($Tp_1$=k*Qa/Ne) wherein Ne is an engine output rotational speed and k is a constant for forming the basic fuel injection rate $Tp_1$ for the certain (preferably, Stoichiometric) fuel-air ratio combustion with the mass flow rate of intake air Qa under the engine output rotational speed Ne. Under the certain (preferably, Stoichiometric) fuel-air ratio combustion, a modification of the fuel injection rate $Tp_1$ is adjusted at each of various levels of the fuel injection rate $Tp_1$ and each of various levels of the engine output rotational speed Ne by a fuel injection rate modification device 117 so that the fuel injection rate $Tp_1$ is correctly set or modified irrespective of an original characteristic deviation and/or characteristic change with the passage of time of the mass flow meter 503 and/or fuel injector 509.

In a datum fuel injection rate determining device 101, a datum fuel injection rate $Tp_2$ corresponding to a desired engine output power per engine rotation or torque, a desired mass flow rate of intake air under the certain (preferably, Stoichiometric) fuel-air ratio combustion, and a desired fuel injection rate is determined from the engine output rotational speed Ne, and a level of an ordered engine output power, for example, an operated degree of an accelerator outside of the controller or an desired engine output power per engine rotation or torque ordered by the controller or by a device outside of the controller. A relationship among the datum fuel injection rate $Tp_2$ under the certain (preferably, Stoichiometric) fuel-air ratio combustion, the level of the ordered engine output power and the engine output rotational speed Ne is predetermined substantially exactly along a relationship among the datum fuel injection rate $Tp_1$ for the certain (preferably, Stoichiometric) fuel-air ratio combustion, the level of the ordered engine output power and the engine output rotational speed Ne. The relationship among the datum fuel injection rate $Tp_2$ under the certain (preferably, Stoichiometric) fuel-air ratio combustion, the level of the ordered engine output power and the engine output rotational speed Ne may be modified in accordance with a variation of the datum fuel injection rate $Tp_1$ for the certain (preferably, Stoichiometric) fuel-air ratio combustion caused by the original characteristic deviation and/or characteristic change with the passage of time of the mass flow meter 503 and/or fuel injector 509.

A fuel-air ratio, an ignition timing, a fuel injection timing and an EGR rate are determined from the datum fuel injection rate $Tp_2$ and the engine output rotational speed Ne for each of Stoichiometric fuel-air ratio combustion, homogeneous lean fuel-air mixture combustion and stratified charge lean fuel-air mixture combustion. Since the datum fuel injection rate $Tp_2$ corresponding to the desired engine output power per engine rotation or torque, the desired mass flow rate of intake air under the certain (preferably, Stoichiometric) fuel-air ratio combustion and the desired fuel injection rate also corresponds to an engine load or the operated degree of the accelerator. Under a common fuel-air ratio combustion, the datum fuel injection rate $Tp_2$ may be equal to the basic fuel injection rate $Tp_1$.

A fuel-air ratio is determined on a fuel-ratio ratio map 104 for Stoichiometric fuel-air ratio combustion, a fuel-ratio ratio map 105 for homogeneous lean fuel-air mixture combustion, and a fuel-ratio ratio map 106 for stratified charge lean fuel-air mixture combustion. An ignition timing is determined on an ignition timing map 107 for Stoichiometric fuel-air ratio combustion, an ignition timing map 108 for homogeneous lean fuel-air mixture combustion, and an ignition timing map 109 for stratified charge lean fuel-air mixture combustion. A fuel injection timing is determined on a fuel injection timing map 110 for Stoichiometric fuel-air ratio combustion, a fuel injection timing map 111 for homogeneous lean fuel-air mixture combustion, and a fuel injection timing map 112 for stratified charge lean fuel-air mixture combustion. An EGR rate is determined on an EGR rate map 113 for Stoichiometric fuel-air ratio combustion, an EGR rate map 114 for homogeneous lean fuel-air mixture combustion, and an EGR rate map 115 for stratified charge lean fuel-air mixture combustion.

Which combustion is carried out, Stoichiometric fuel-air ratio combustion, homogeneous lean fuel-air mixture combustion, or stratified charge lean fuel-air mixture combustion is determined by a combustion mode switching device 120 as described below with reference to FIG. 14.

An instruction signal for controlling the fuel injection rate or fuel injection pulse width is determined on the basis of the datum fuel injection rate $Tp_2$ with adding thereto a datum change value $\Delta TP_2$ and a fuel injector idling value Ts and subsequently modifying the post-addition datum fuel injection rate $Tp_2$ in accordance with an $O_2$ modification coefficient and an F/B modification coefficient. If the Stoichiometric fuel-air ratio combustion is carried out, the post-addition datum fuel injection rate $Tp_2$ is modified on the basis of the basic fuel injection rate $Tp_1$ before being modified in accordance with an $O_2$ modification coefficient and an F/B modification coefficient.

A target value signal corresponding to a target fuel injection rate $Tp_3$ corresponding to a desired mass flow rate of intake air for controlling the mass flow rate of intake air is determined in a target value signal generator 124 on the basis of the datum fuel injection rate or desired mass flow rate of intake air $Tp_2$ under the certain (preferably, Stoichiometric) fuel-air ratio with adding thereto the datum change value $\Delta TP_2$ and modified in accordance with a ratio between the certain (preferably, Stoichiometric) fuel-air ratio (for example, 14,7) and a desired fuel-air ratio (for example, 40). An instruction signal to be input to a driver 119 of the throttle valve 1103 for controlling an opening degree of the throttle valve 1103 to determine the actual mass flow rate of intake air for the desired mass flow rate of intake air is determined in an I-PD controller 118 on the basis of a comparison between the target fuel injection rate $Tp_3$ as the claimed input signal and the basic fuel injection rate $Tp_1$ as the claimed actual engine condition signal under the certain (preferably, Stoichiometric) fuel-air ratio combustion, that is, on the basis of a comparison between the desired mass flow rate of intake air and the measured actual mass flow rate of intake air Qa so that a difference between the desired mass flow rate of intake air and the measured actual mass flow rate of intake air Qa is decreased.

Figure 5:
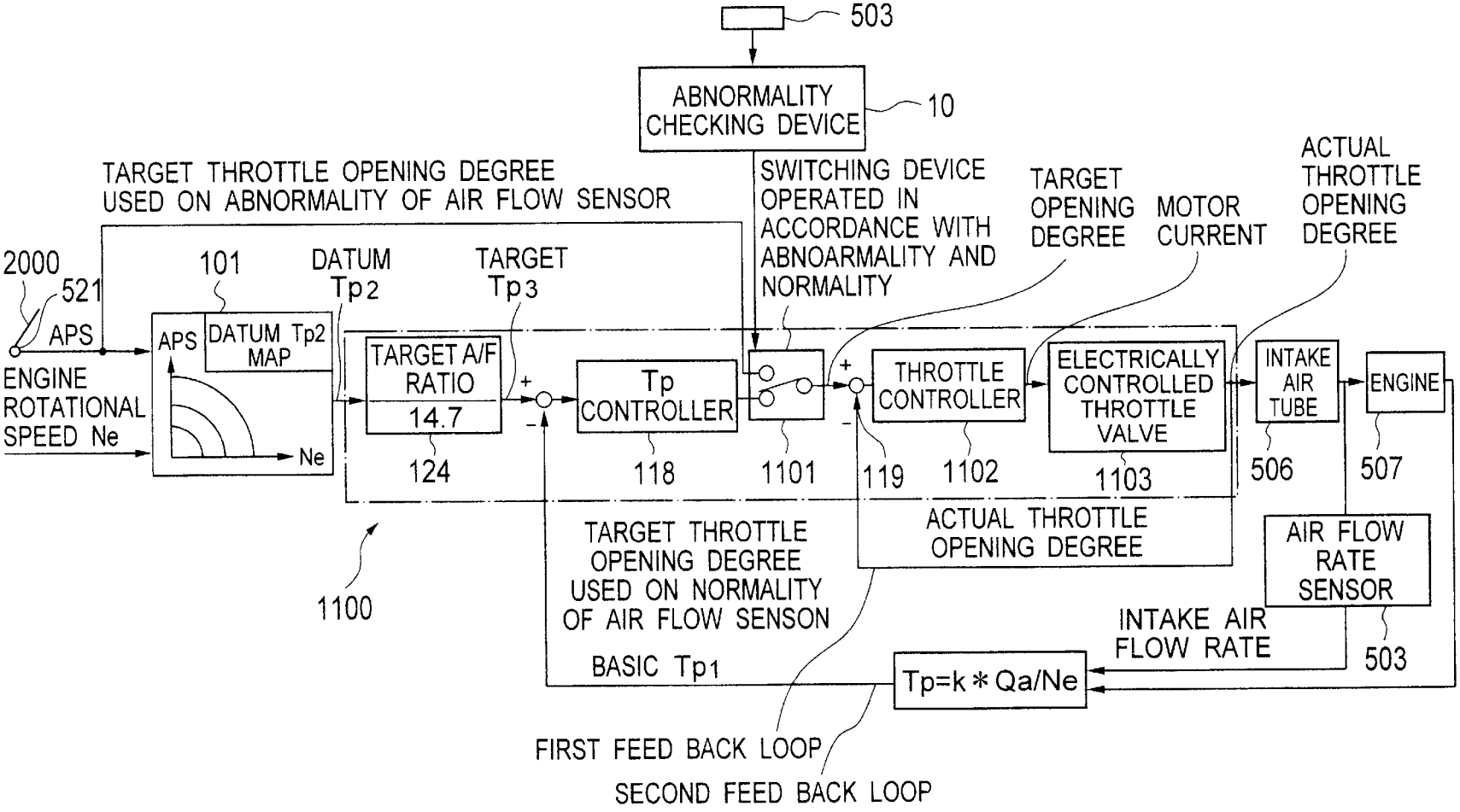
FIG. 5 is a schematic view showing an embodiment of a feed-back system of the engine controller of the invention.

As shown in FIG. 5, if a trouble of the mass flow meter 503 as the claimed engine condition measuring sensor is detected in response to, for example, that a magnitude of an output signal of the mass flow meter 503 is in a range other than a predetermined range, a fail safe switching device 1101 supplies the instruction signal corresponding to an operated degree of an accelerator 2001 or a desired mass flow rate of intake air corresponding to a desired output power ordered by the accelerator 2001 to a drive controller 1102 of the throttle valve 1103, instead of the instruction signal determined in the I-PD controller 118 on the basis of the comparison between the desired mass flow rate of intake air corresponding to the desired output power and the actual mass flow rate of intake air. The desired mass flow rate of intake air corresponding to the desired output power is predetermined in an interface device 101 on the basis of the operated degree of the accelerator 2001 and the engine output rotational speed, and subsequently modified in the target value signal generator 124 in accordance with a ratio between the certain (preferably, Stoichiometric) fuel-air ratio (for example, 14,7) and the desired fuel-air ratio.

Figure 6:
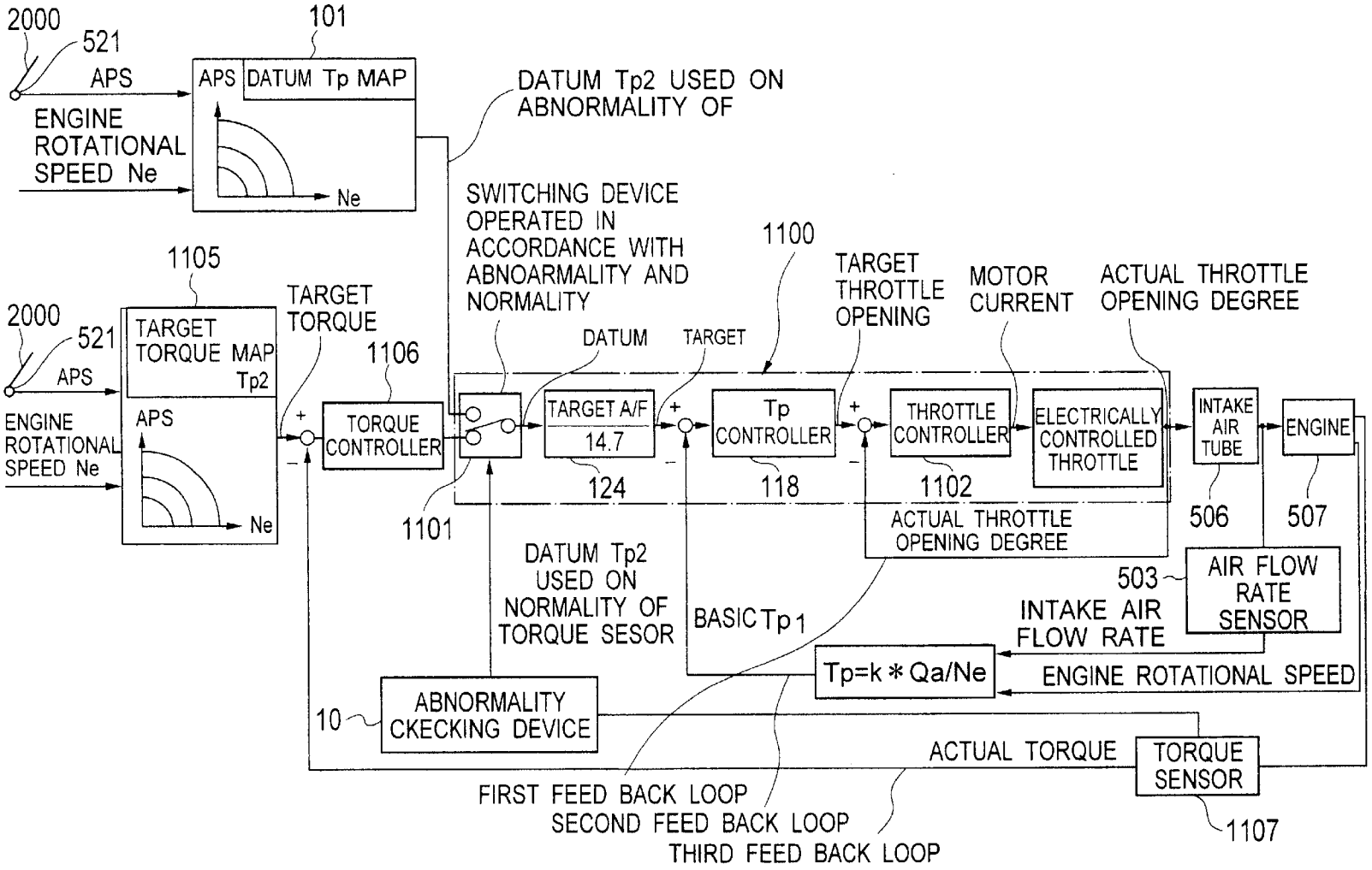
FIG. 6 is a schematic view showing another embodiment of a feed-back system of the engine controller of the invention.

As shown in FIG. 6, if a trouble of a torque sensor 1107 for generating an actual engine condition signal corresponding to an actual engine output torque as the claimed engine condition measuring sensor is detected in response to, for example, that a magnitude of an output signal of the torque sensor 1107 is in a range other than a predetermined range, the fail safe switching device 1101 supplies the instruction signal corresponding to the desired mass flow rate of intake air under the certain (preferably, Stoichiometric) fuel-air ratio corresponding to the desired output power determined in the interface device 101 on the basis of the operated degree of the accelerator 2001 and the engine output rotational speed to the drive controller 1102 of the throttle valve 1103 through the target value signal generator 124, instead of the instruction signal determined in a torque comparator 1106 on the basis of a comparison between a desired engine output torque corresponding to the desired output power and an actual engine output torque measured by the torque sensor 1107. The desired engine output torque is determined in an interface device 1105 on the basis of the operated degree of the accelerator 2001 and the engine output rotational speed.

Figure 7:
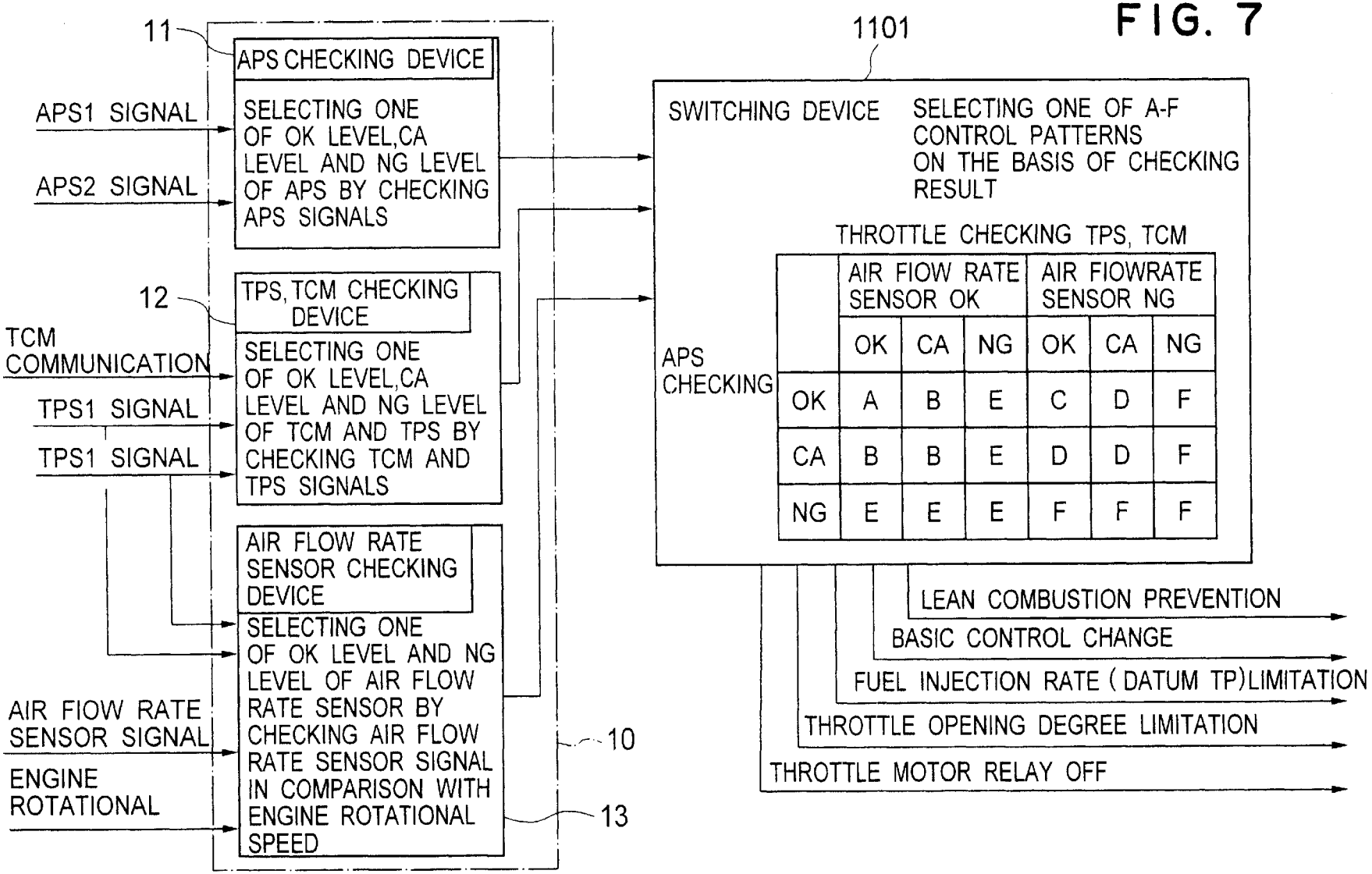
FIG. 7 is a schematic view showing control data flow processes for detecting and evaluating an abnormality of the feed-back system of the engine controller of the invention.

As shown in FIG. 7, an abnormality detection or evaluation is carried out in an abnormality detecting device 10 and the fail safe switching device 1101. The abnormality detecting device 10 includes an accelerator abnormality detecting device 11 for determining, as sown in FIG. 12, an abnormality level of OK, CA(cautionary) or NG(no-good) of the accelerator 2001 from signals APS1 and APS2 of the sensors 521 corresponding to the operated degree of the accelerator, a throttle abnormality detecting device 12 for determining, as shown in FIGS. 10 and 11, an abnormality level of OK, CA(cautionary) or NG(no-good) of the throttle valve 1103 from output signals TPS1 and TPS2 of the sensors 504 corresponding to the opened degree of the throttle valve 1103 and a signal corresponding to a condition of a communication line or device between the sensors and the controller, a mass flow meter abnormality detecting device 13 for determining an abnormality level of OK, CA(cautionary) or NG(no-good) of the mass flow meter 503 for measuring the mass flow rate of the intake air from an output signal of the mass flow meter 503 and the engine output rotational speed. The fail safe switching device 1101 determines, as shown in FIG. 8, a generic abnormality level of A–F (A: normal level, F: most considerable abnormality level) from the above mentioned abnormality levels, and instructs, as shown in FIG. 9, at least one of a prevention of a feed-back control, a prevention of forming a lean fuel air mixture, a decrease of an upper limit of an injection rate of a fuel to be injected into the engine, a decrease of an upper limit of an opening degree of a throttle as the engine condition adjusting device (1103), a close of the throttle and a prevention of supplying an electric current to the throttle (for default opening degree of the throttle) if the generic abnormality level of B–F is determined.

Figure 13:
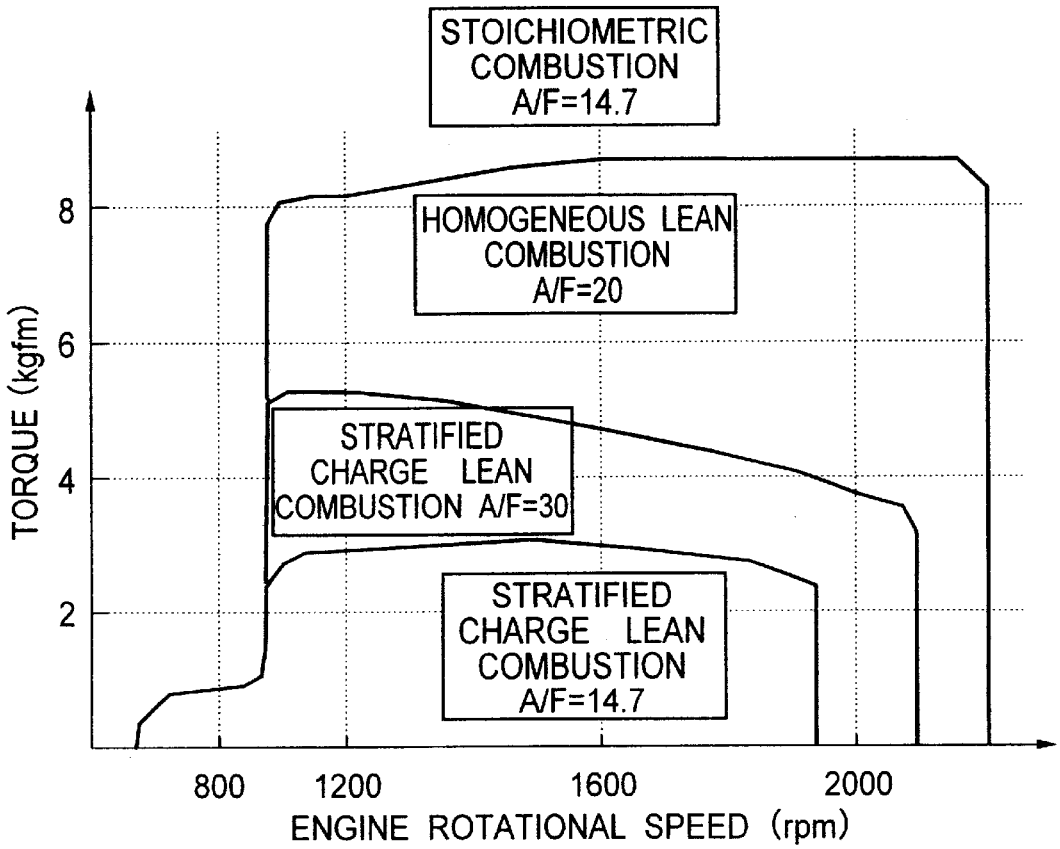
FIG. 13 is a diagram showing relationships between an engine output torque, an engine output rotational speed and various combustion modes.

In FIG. 13, a relationship among the engine output rotational speed, the desired engine output torque, and a necessary fuel-air ratio is shown so that a desirable combustion mode and a desirable fuel-air ratio are determined from the engine output rotational speed and the desired engine output torque.

Figure 14:
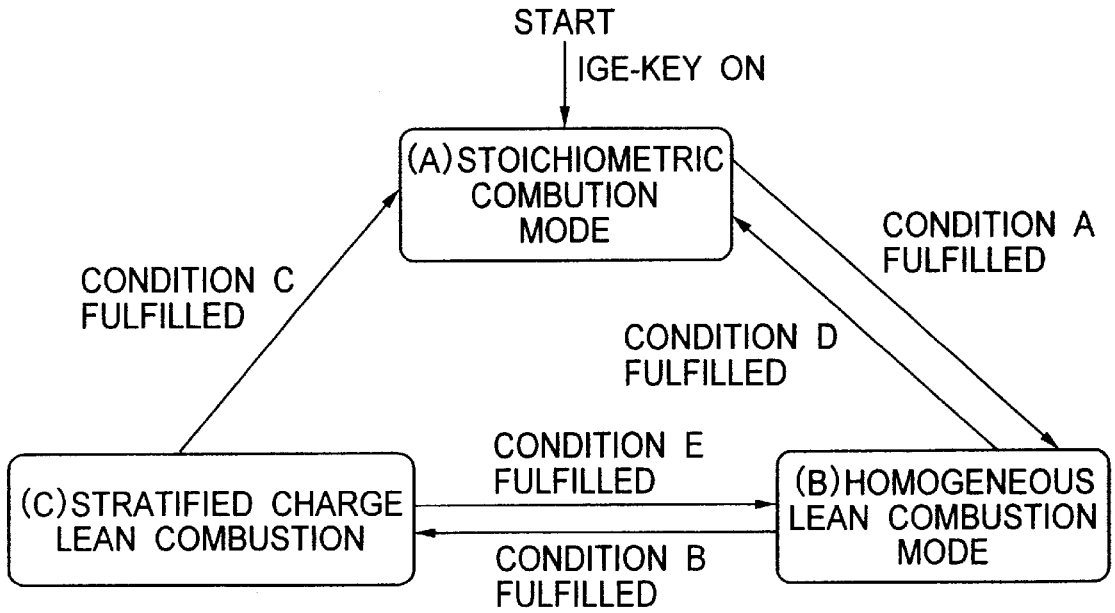
FIG. 14 is a diagram showing relationships among various combustion modes.

As shown in FIG. 14, the combustion mode is changed. Just after the engine operation is started, the Stochiometric fuel-air mixture combustion is carried out. If a condition is A is satisfied, the combustion mode to be carried out is changed from the Stochiometric fuel-air mixture combustion to a homogeneous lean fuel-air mixture combustion. If a condition B is satisfied at the homogeneous lean fuel-air mixture combustion, the combustion mode to be carried out is changed from the homogeneous lean fuel-air mixture combustion to the stratified charge lean fuel-air mixture combustion. If a condition C is satisfied at the stratified charge lean fuel-air mixture combustion, the combustion mode to be carried out is changed from the stratified charge lean fuel-air mixture combustion to the Stochiometric fuel-air mixture combustion. If a condition E is satisfied at the stratified charge lean fuel-air mixture combustion, the combustion mode to be carried out is changed from the stratified charge lean fuel-air mixture combustion to the homogeneous lean fuel-air mixture combustion. If a condition D is satisfied at the homogeneous lean fuel-air mixture combustion, the combustion mode to be carried out is changed from the homogeneous lean fuel-air mixture combustion to the Stochiometric fuel-air mixture combustion.

The condition A is satisfied when a desired fuel-air ratio determined on an A/F map (showing a relationship among a desirable fuel-air ratio, the engine output rotational speed and the desired output torque or fuel injection rate) for Stochiometric combustion is not less than 20, an actual engine coolant temperature is not less than 40° C., and an increase of the fuel injection rate is not required. The condition B is satisfied when the desired fuel-air ratio determined on an A/F map for the homogeneous lean combustion is not less than 30. The condition C is satisfied when a fuel injection prevention is ordered during deceleration of the engine output rotational speed. The condition D is satisfied when the desired fuel-air ratio determined on an A/F map for the homogeneous lean combustion is not more than 19. The condition E is satisfied when the desired fuel-air ratio determined on an A/F map for the stratified charge lean combustion is not more than 28. In accordance with the change of the combustion mode, an ignition map showing a relationship among a desirable ignition timing, the engine output rotational speed and the desired output torque or fuel injection rate, a fuel injection timing map showing a relationship among a desirable fuel injection timing, the engine output rotational speed and the desired output torque or fuel injection rate and EGR map showing a relationship among an EGR rate, the engine output rotational speed and the desired output torque or fuel injection rate is changed.

The desired output power $TP_2$ may be determined on a map showing a relationsip among the desired output power $TP_2$, the engine output rotational speed and the operated degree of the accelerator as shown in FIG. 15. The map may modified or corrected as shown in FIG. 16 so that under the certain (preferably, Stoichiometric) fuel-air ratio combustion, the desired mass flow rate of intake air corresponding to the desired output power $TP_2$ is equal to the measured actual mass flow rate of intake air.

Figure 18:
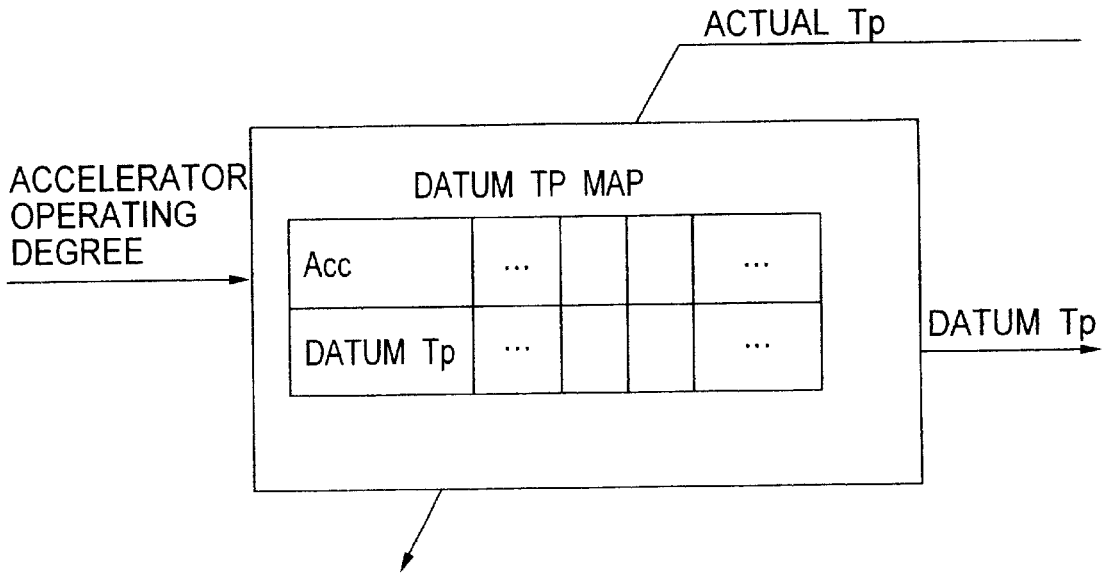
FIG. 18 is a block diagram showing a control unit containing the table of FIG. 17.

The desired output power $TP_2$ may be determined on a table showing a relationsip among the desired output power $TP_2$ and the operated degree of the accelerator as shown in FIG. 17. The table may modified or corrected as shown in FIG. 18 so that under the certain (preferably, Stoichiometric) fuel-air ratio combustion, the desired mass flow rate of intake air corresponding to the desired output power $TP_2$ is equal to the measured actual mass flow rate of intake air.

Figure 19:
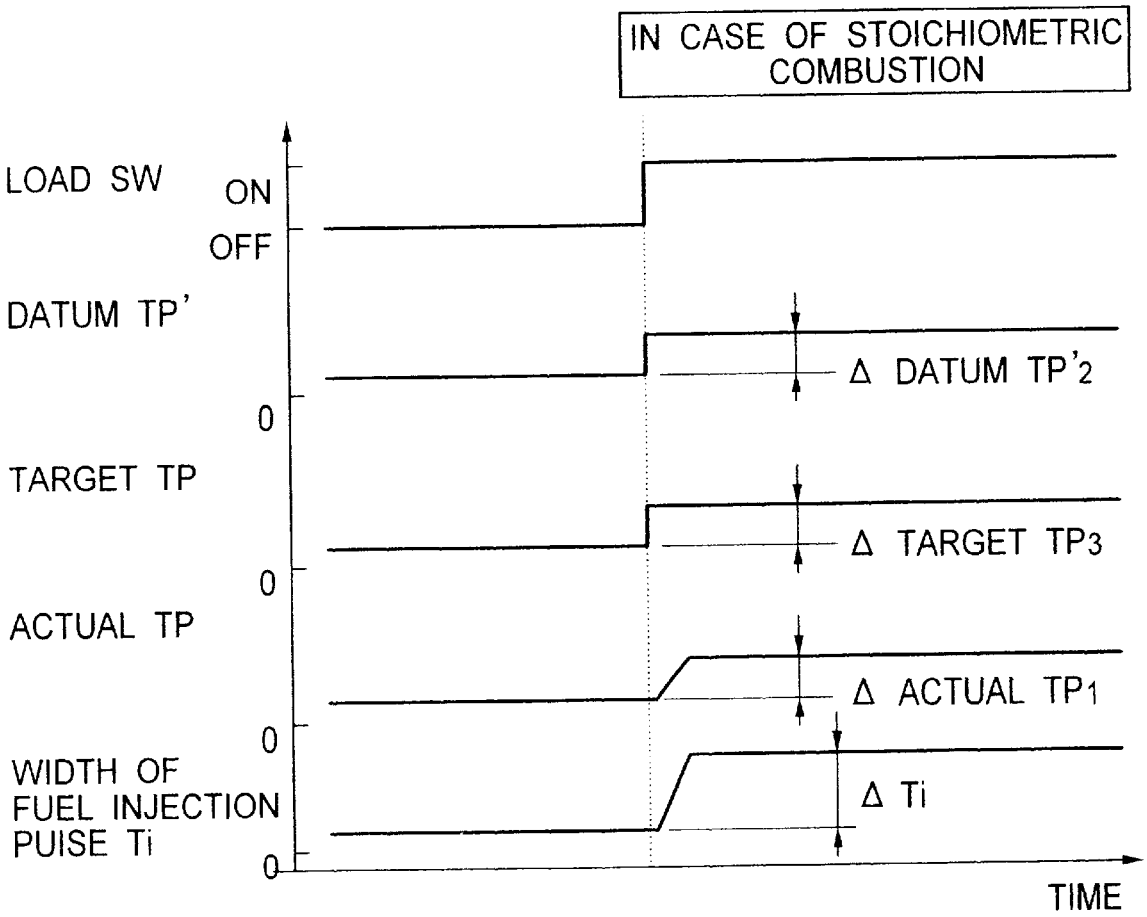
FIG. 19 is a diagram showing a relationship among a load switch condition, the desired output power $TP_2$ (corresponding to the desired fuel injection rate and/or the desired mass flow rate of an air to be supplied into the engine under the certain fuel-air ratio), a desired mass flow rate of an air to be supplied into the engine modified according to a variation of the fuel-air ratio, an actual mass flow rate of the air to be supplied into the engine, and an actual fuel injection rate, under a Stoichiometric combustion.
Figure 20:
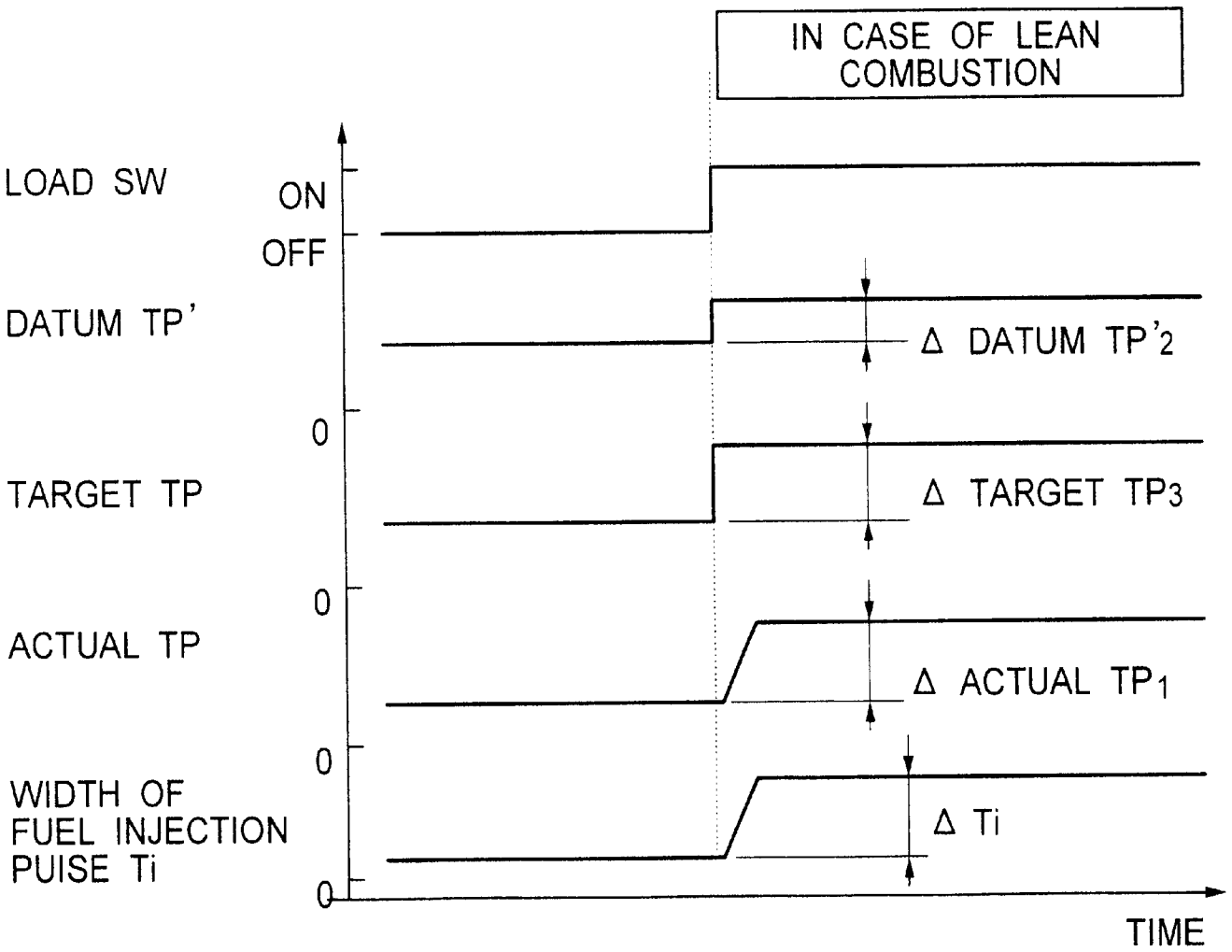
FIG. 20 is a diagram showing a relationship among a load switch condition, the desired output power $TP_2$ (corresponding to the desired fuel injection rate and/or the desired mass flow rate of an air to be supplied into the engine under the certain fuel-air ratio), a desired mass flow rate of an air to be supplied into the engine modified according to a variation of the fuel-air ratio, an actual mass flow rate of the air to be supplied into the engine, and an actual fuel injection rate, under a lean burn combustion.

In FIG. 19 showing a relationship among a time, a load switch On or Off, the desired output power, fuel injection rate or mass flow rate of intake air $TP_2$ under the Stoichiometric fuel-air ratio combustion, the desired mass flow rate of intake air $Tp_3$ under the Stoichiometric fuel-air ratio combustion, the measured actual mass flow rate of intake air $Tp_1$, and the actual fuel injection rate or pulse width, an increase value $\Delta TP_2$ of the desired mass flow rate of intake air $TP_2$ is equal to an increase value $\Delta TP_3$ of the desired mass flow rate of intake air $TP_3$. In FIG. 20 showing a relationship among a time, a load switch On or Off, the desired output power, fuel injection rate or mass flow rate of intake air $TP_2$ under the certain (preferably, Stoichiometric) fuel-air ratio combustion, the desired mass flow rate of intake air $Tp_3$ under the desired lean fuel-air ratio combustion, the measured actual mass flow rate of intake air $Tp_1$, and the actual fuel injection rate or pulse width, an increase value $\Delta TP_2$ of the desired mass flow rate of intake air $TP_2$ is smaller than an increase value $\Delta TP_3$ of the desired mass flow rate of intake air $TP_3$ by a ratio between certain (preferably, Stoichiometric) fuel-air ratio and the desired lean fuel-air ratio.

Figure 21:
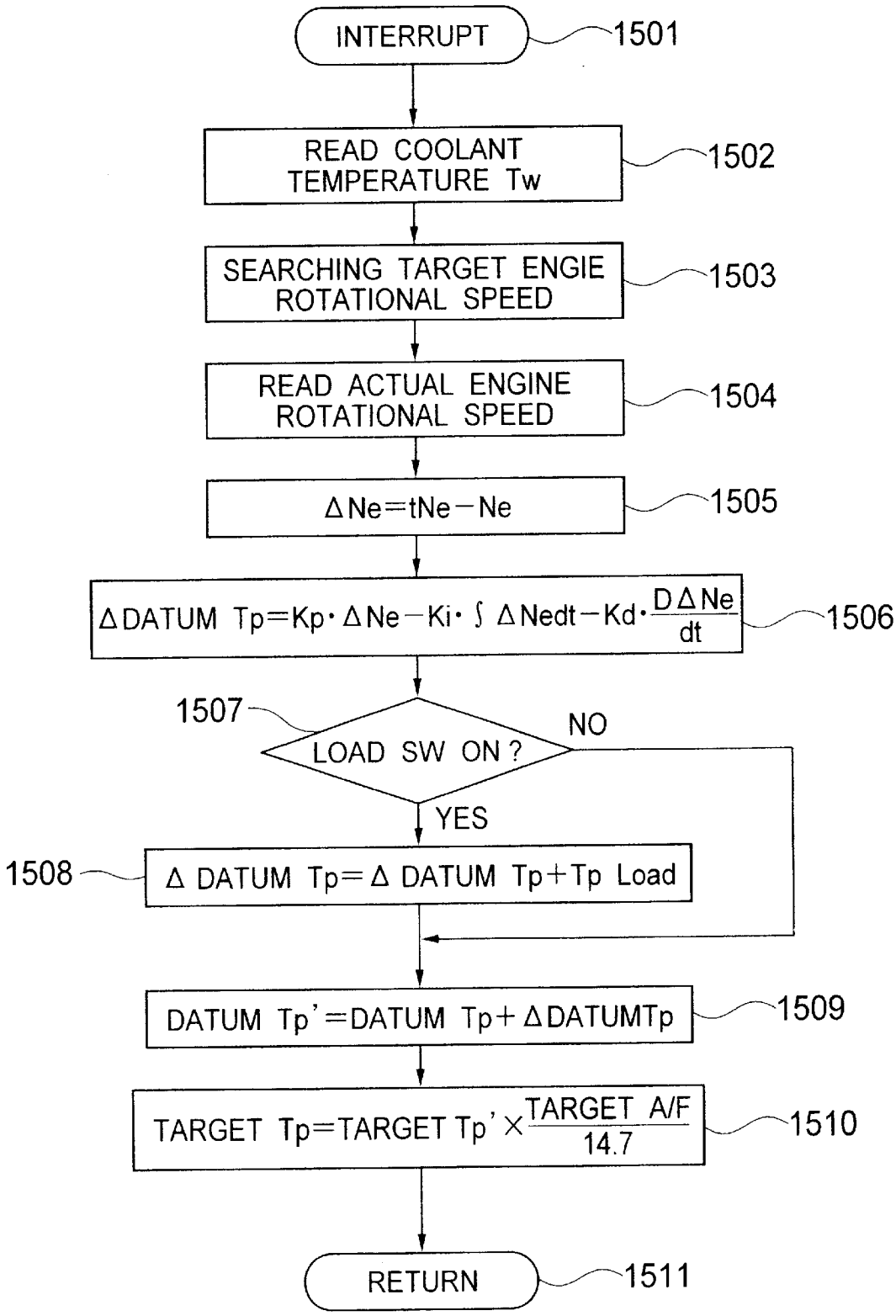
FIG. 21 is a flow chart for determining the desired mass flow rate of the air to be supplied into the engine.
Figure 22:
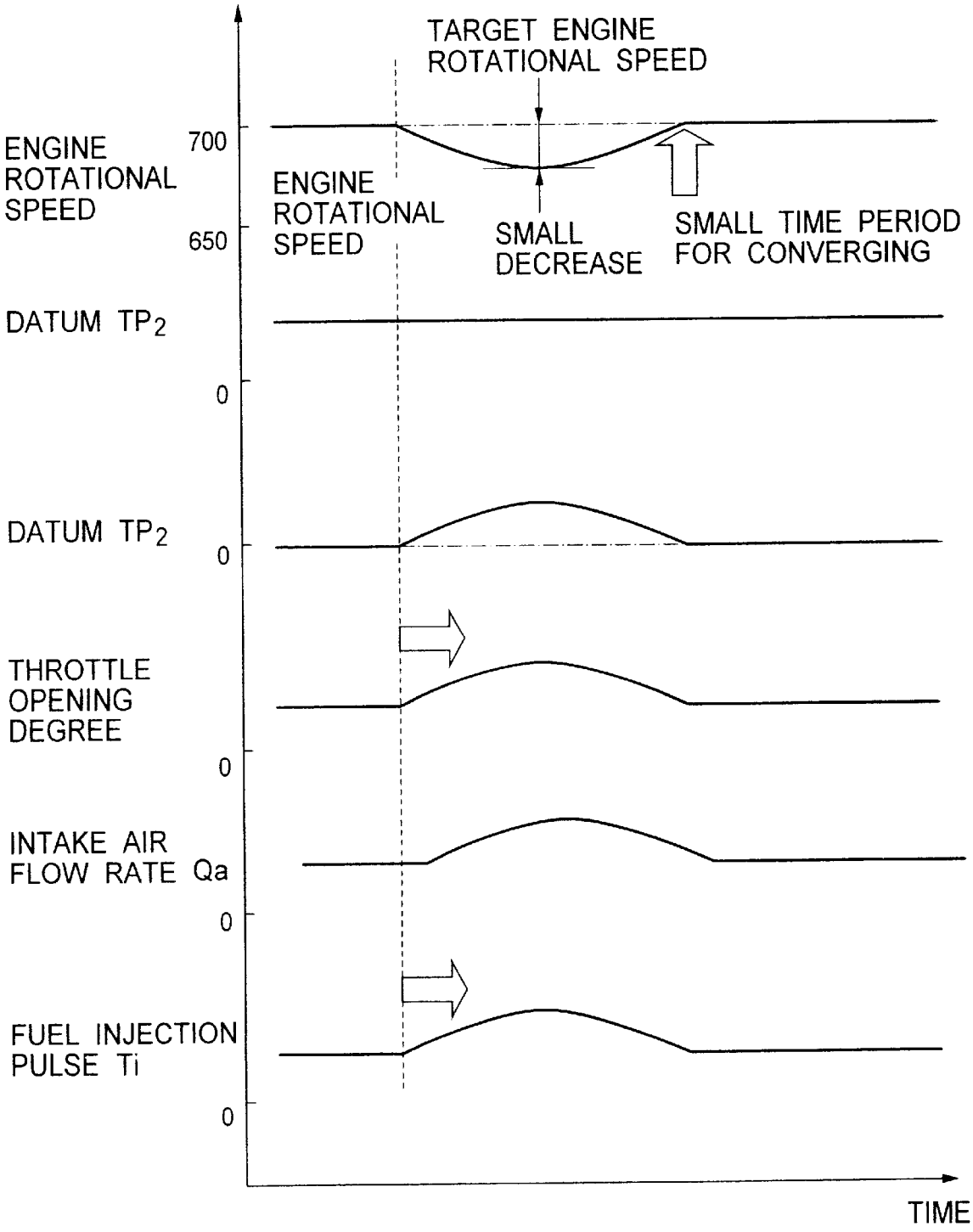
FIG. 22 is a diagram showing a relationship among an engine output rotational speed, a desired output power $TP_2$ (corresponding to the desired fuel injection rate and/or the desired mass flow rate of an air to be supplied into the engine under the certain fuel-air ratio), an opening degree of the throttle, a mass flow rate of an air supplied into the engine, and a fuel injection rate, in the engine of the invention.

A control sequence as shown in FIG. 21 is repeated by each predetermined time interval (for example, 10 Ohms) to determine the desired mass flow rate of intake air $TP_3$. A difference $\Delta Ne$ between a desired engine output rotational speed tNe determined on the basis of a measured engine coolant temperature Tw and the measured actual engine output rotational speed Ne is calculated. The increase value $\Delta TP_2$ of the desired mass flow rate of intake air or fuel injection rate $TP_2$ under the certain fuel-air ratio is predetermined along a formula shown in step 1506, and an additional increase value Tp-load is added to the increase value $\Delta TP_2$ when an additional output power or torque is ordered by the load switch. The increase value $\Delta TP_2$ is added to the desired mass flow rate of intake air or fuel injection rate $TP_2$, and an total amount of the increase value $\Delta TP_2$ and the desired mass flow rate of intake air or fuel injection rate $TP_2$ under the certain fuel-air ratio is converted to the desired mass flow rate $TP_3$ of intake air under the desired fuel-air ratio, and is used as the desired intake air or fuel injection rate. Since the increase value $\Delta TP_2$ is added to the desired mass flow rate of intake air or fuel injection rate $TP_2$ when the measured actual engine output rotational speed Ne is smaller than the desired engine output rotational speed tNe, as shown in FIG. 22, the actual engine output rotational speed Ne reaches rapidly the desired engine output rotational speed tNe.

Figure 23:
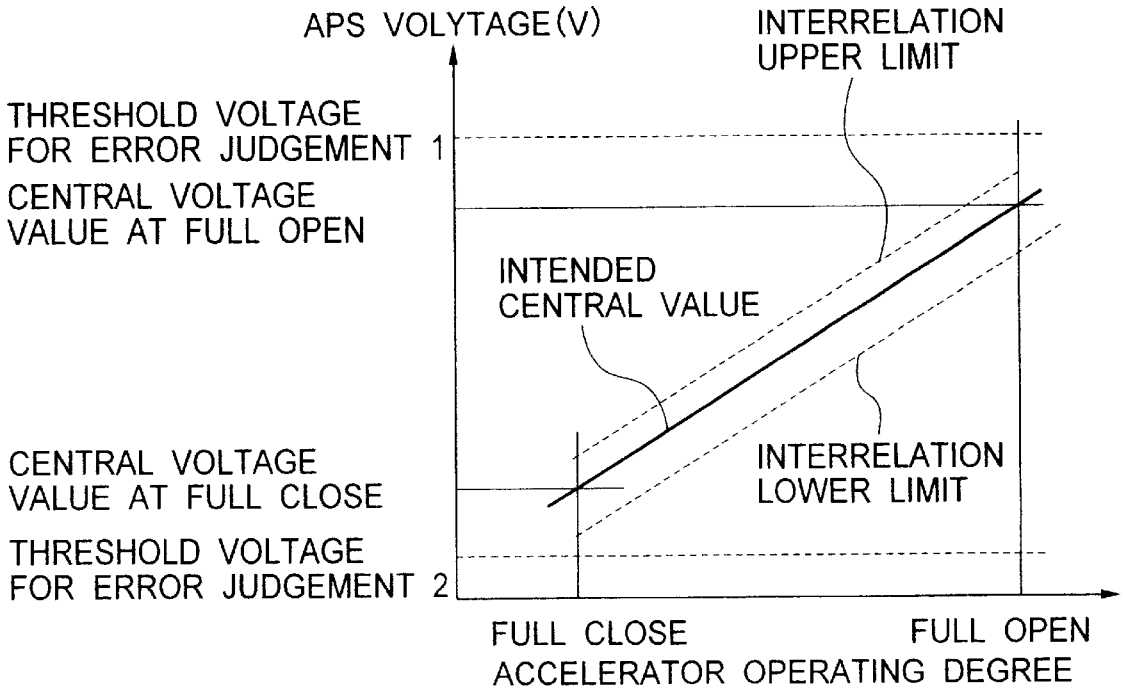
FIG. 23 is a diagram showing an acceptable range of an accelerator sensor signal magnitude in a predetermined accelerator movable range.
Figure 24:
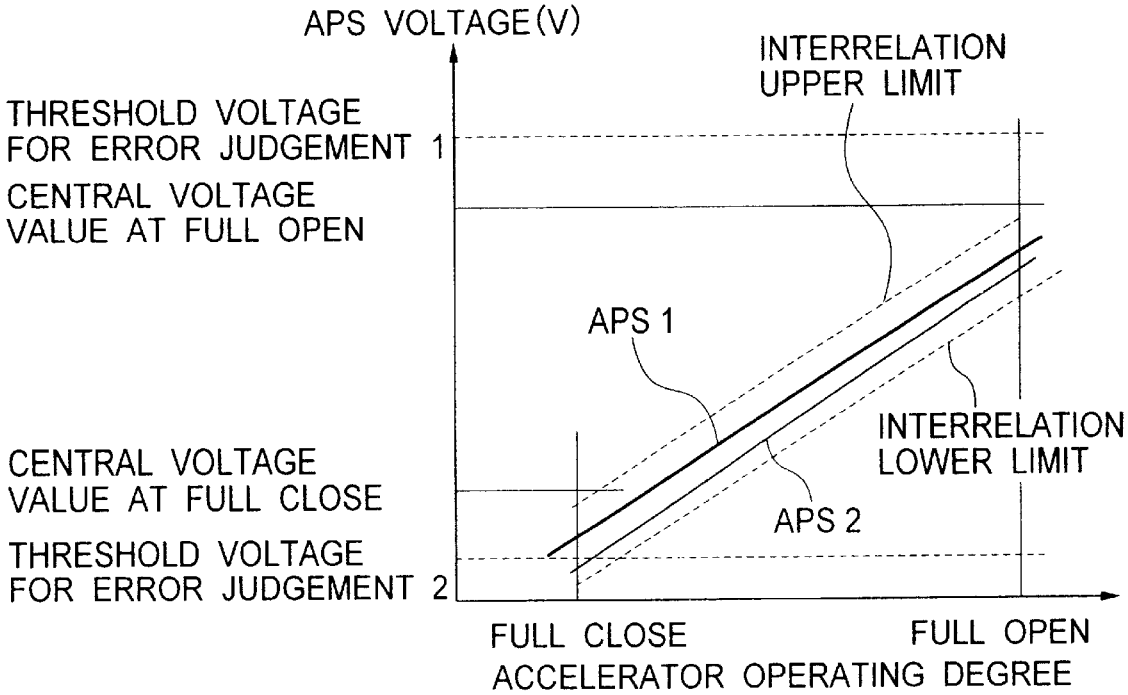
FIG. 24 is a diagram showing an acceptable range of an accelerator sensor signal difference in a predetermined accelerator movable range.
Figure 25:
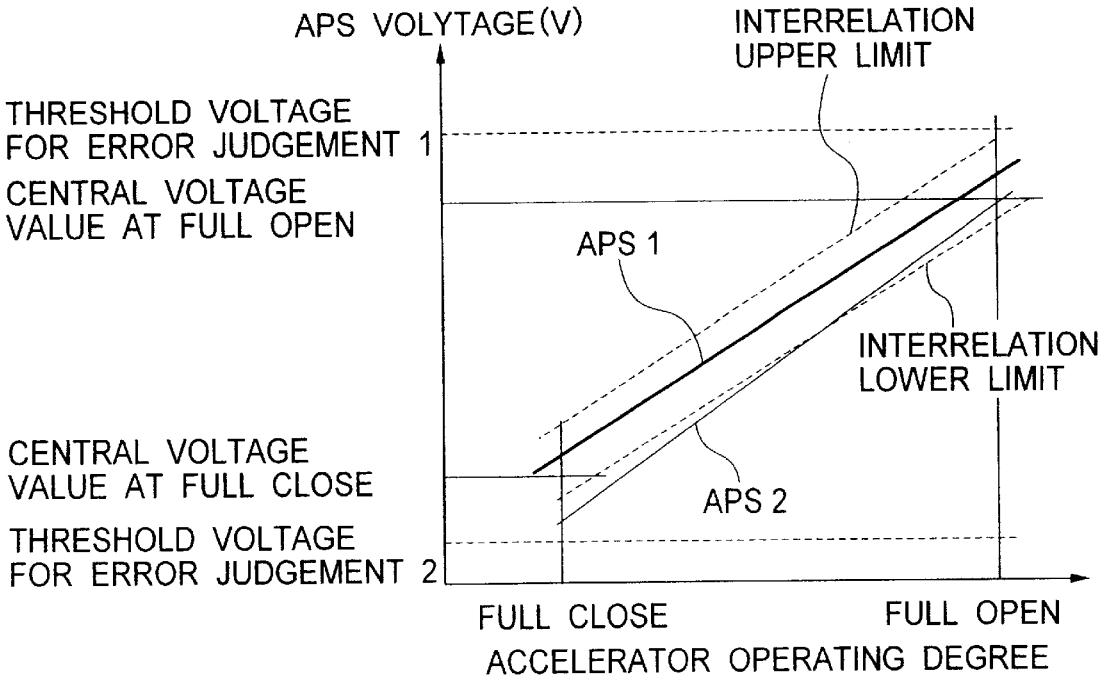
FIG. 25 is a diagram showing an acceptable range of difference in accelerator sensor signal in a predetermined accelerator movable range.

If the actual engine condition (mass flow rate, output torque or the like) or the condition of the engine condition adjusting device (accelerator, throttle or the like) is detected by a sensor, a trouble of the sensor can be detected, for example, when a magnitude of the output signal of the sensor is in a range other than a predetermined acceptable range. If the actual engine condition (mass flow rate, output torque or the like) or the condition of the engine condition adjusting device (accelerator, throttle or the like) is detected by at least two sensor, a trouble of at least one of the sensors may be detected, for example, when a difference between the output signals of the sensors is more than a predetermined level. For example, in the accelerator abnormality detecting device 11, a trouble of the accelerator 2000 or accelerator sensor 521 is detected as shown in each of FIGS. 23–25. As shown in FIG. 23, within the accelerator movable range, when a magnitude of the output signal(s) of the accelerator sensor(s) 521 is within an acceptable range between an output signal upper limit of threshold voltage for error judgement 1 and an output signal lower limit of threshold voltage for error judgement 2, non-trouble of the accelerator 2000 or accelerator sensor 521 is detected. As shown in FIG. 24, within the accelerator movable range, when the magnitude of the output signal(s) of the accelerator sensor(s) 521 is not within the acceptable range, the trouble of the accelerator 2000 or accelerator-sensor 521 is detected. As shown in FIG. 25, within the accelerator movable range, when a difference between the output signals of the accelerator sensors 521 at a certain accelerator position is not within the acceptable range, the trouble of the accelerator 2000 or accelerator sensor(s) 521 is detected.

Figure 26:
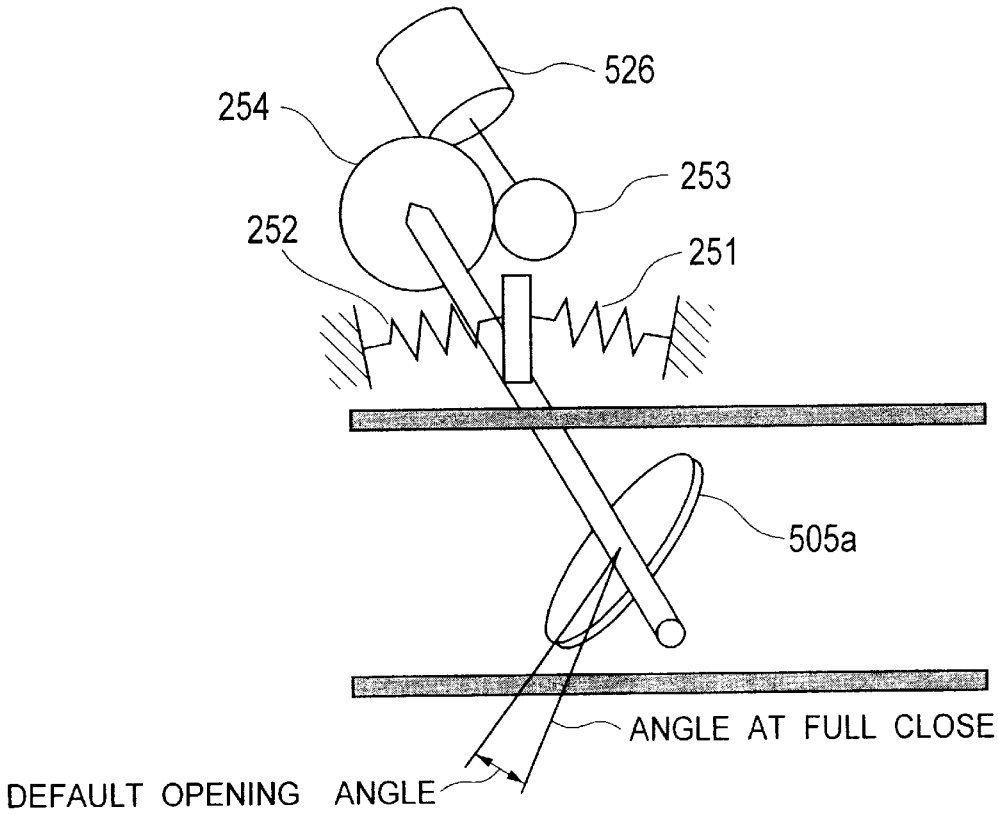
FIG. 26 is a schematic view showing a structure of an electrically controlled throttle.

As shown in FIG. 26, since the throttle valve 505*a* is urged toward an intermediate position between full-open and full-close positions thereof by springs 252 and 251, the throttle valve 505*a* is maintained at a default position near the full-close position when a throttle valve drive motor 526 is not energized.

Figure 27:
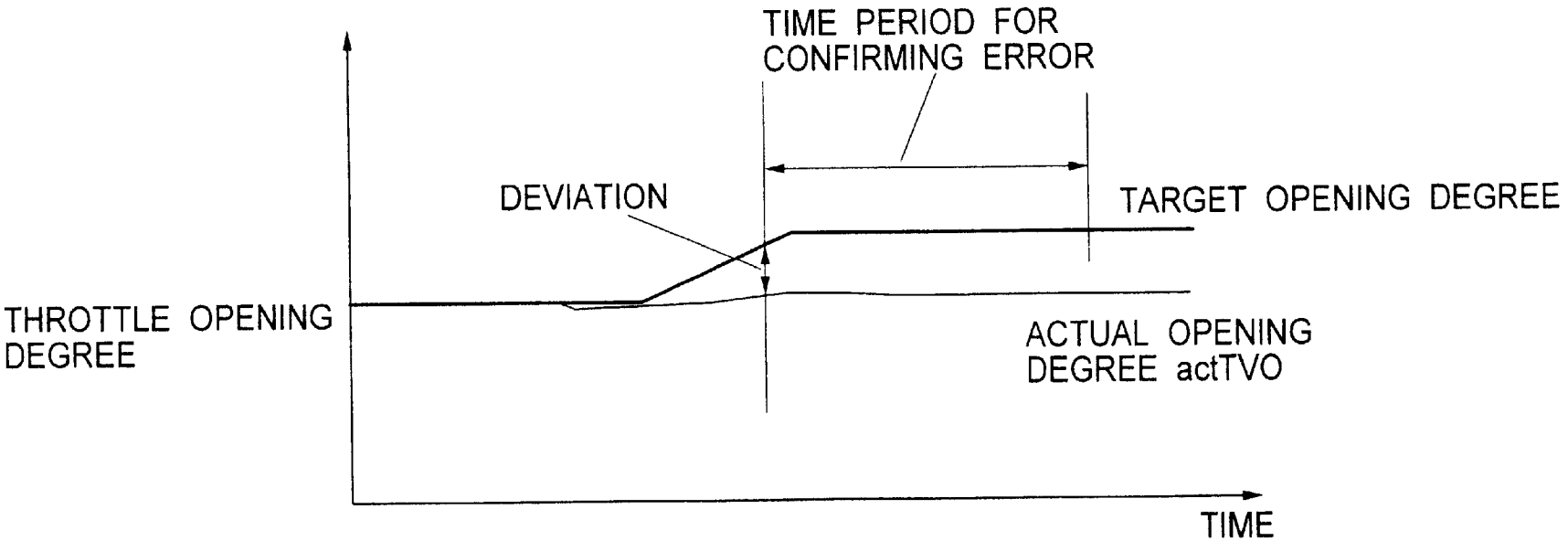
FIG. 27 is a diagram showing a relationship among a time, an actual throttle opening degree and a desired throttle opening degree.

A trouble of the throttle is detected when, for example, a difference or deviation between the desired open degree of the throttle and the actual open degree of the throttle measured by the sensor 504 is kept more than a predetermined value for a time period more than a predetermined time period, as shown in FIG. 27.

What is claimed is:

1. An engine controller for controlling an engine condition adjusting device in an engine in consideration of an actual engine condition measured by an engine condition measuring sensor, comprising an interface device for generating an input signal corresponding to a desired engine condition, and an instruction signal generator for determining an instruction signal to be input to the engine condition adjusting device for controlling an operation degree of the engine condition adjusting device on the basis of a comparison between the input signal and an actual engine condition signal corresponding to the actual engine condition so that a difference between the desired engine condition and the measured actual engine condition is decreased, wherein the instruction signal for controlling the engine condition adjusting device is determined on the basis of the comparison between the input signal and the actual engine condition changing device and the engine condition measuring sensor are detected, and is determined on the basis of the input signal while preventing the instruction signal from being determined on the basis of the comparison between the input signal and the actual engine condition signal when an abnormality of at least one of the engine condition changing device and the engine condition measuring sensor is detected, the engine condition adjusting device is at least one of a throttle valve and fuel injector, and the engine condition measuring sensor is at least one of an intake air mass flow meter and an output torque sensor.

2. An engine controller according to claim 1, wherein the interface device generates the input signal corresponding to a desired engine output power ordered from an accelerator outside of the engine controller.

3. An engine controller according to claim 1, wherein the interface device generates the input signal corresponding to a desired engine output power as the desired engine condition.

4. An engine controller according to claim 3, wherein the interface device generates the input signal corresponding to the desired engine output power on the basis of an engine output rotational speed and an instructed engine output power instructed from and accelerator outside of the engine controller.

5. An engine controller according to claim 1, wherein the interface device generates the input signal corresponding to a desired engine output torque as the desired engine condition.

6. An engine controller according to claim 1, wherein the interface device generates the input signal corresponding to a desired mass flow rate of an intake air to be taken into the engine, as the desired engine condition.

7. An engine controller according to claim 6, further comprising a modifier for modifying the input signal in accordance with a desired air-fuel ratio.

8. An engine controller according to claim 1, wherein the interface device generates the input signal corresponding to a desired injection rate of a fuel to be injected into the engine, as the desired engine condition.

9. An engine controller according to claim 1, wherein the instruction signal generator determines the instruction signal for controlling an opening degree of an electrically controlled throttle as the engine condition adjusting device.

10. An engine controller according to claim 9, further comprising a modifier for modifying the instruction signal in accordance with a desired air-fuel ratio.

11. An engine controller according to claim 1, wherein the instruction signal generator determines the instruction signal for controlling an injection rate of a fuel to be injected into the engine.

12. An engine controller according to claim 1, wherein the actual engine condition signal corresponds to an actual mass flow rate of an intake air to be taken into the engine.

13. An engine controller according to claim 1, wherein the actual engine condition signal corresponds to an actual engine output torque.

14. An engine controller according to claim 1, wherein the actual engine condition signal corresponds to an actual engine output power.

15. An engine controller according to claim 1, wherein a desired injection rate of a fuel to be injected into the engine corresponds to a desired engine output power as the desired engine condition.

16. An engine controller according to claim 1, wherein a throttle of the engine condition changing device for controlling a mass flow rate of an intake air to be taken into the engine includes at least one additional sensor for generating an output signal corresponding to an opening degree of the throttle, and the abnormality of the engine condition changing device is an abnormality of the at least one additional sensor.

17. An engine controller according to claim 16, wherein the abnormality of the at least one additional sensor is in a range other than a predetermined range.

18. An engine controller according to claim 16, wherein the abnormality of the at least one additional sensor is detected when a difference between a plurality of the output signals of a plurality of the additional sensors is more than a predetermined level.

19. An engine controller according to claim 1, wherein the operation degree of the engine condition adjusting device is an opening degree of a throttle for adjusting a mass flow rate of an intake air to be taken into the engine.

20. An engine controller according to claim 1, wherein the operation degree of the engine condition adjusting device is an injection rate of a fuel to be injected into the engine.

21. An engine controller according to claim 1, wherein the abnormality of the engine condition measuring sensor is detected when a magnitude of the actual engine condition signal corresponding to the actual engine condition is in a range other than a predetermined range.

22. An engine controller according to claim 1, wherein the desired condition corresponding to the input signal compared to the actual engine condition signal to determined the instruction signal when the normalities of the interface device, the engine condition changing device and the engine condition measuring sensor are detected is different from the desired condition corresponding to the input signal on the basis of which the instruction signal is determined when the abnormality of the at least one of the engine condition changing device and the engine condition measuring sensor is detected.

23. An engine controller according to claim 1, wherein the desired condition corresponding to the input signal compared to the actual engine condition signal to determined the instruction signal when the normalities of the interface device, the engine condition changing device and the engine condition measuring sensor are detected to equal to the desired condition corresponding to the input signal on the basis of which the instruction signal is determined when the abnormality of the at least one of the engine condition changing device and the engine condition measuring sensor is detected.

24. An engine controller according to claim 1, wherein the engine condition adjusting device is a fuel-air supply device.

25. An engine controller according to claim 24, wherein the fuel-air supply device includes at least one of a throttle valve and a fuel injector.

26. An engine controller according to claim 2, wherein the engine condition measuring device includes at least one of an intake air mass flow meter and an engine output torque sensor.

27. An engine controller for controlling an engine condition adjusting device in an engine in consideration of an actual engine condition measured by an engine condition measuring sensor, comprising, an interface device for generating an input signal corresponding to a desired engine condition, and an instruction signal generator for determining an instruction signal to be input to the engine condition adjusting device for controlling an operation degree of the engine condition adjusting device on the basis of a comparison between the input signal and the actual engine condition signal corresponding to the actual engine condition so that a difference between the desired engine condition and the measured actual engine condition is decreased, wherein, the instruction signal for controlling the engine condition adjusting device is determined on the basis of the comparison between the input signal and the actual engine condition signal when normalities of the interface device, the engine condition changing device and the engine condition measuring sensor are detected, and is determined on the basis of the input signal while preventing the instruction signal from being determined on the basis of the comparison between the input signal and the actual engine condition signal when an abnormality of at least one of the interface device, the engine condition changing device and the engine condition measuring sensor is detected, wherein an actual mass flow rate of an intake air to be taken into the engine corresponds to an actual engine output power when an air-fuel ratio is kept at a certain degree, so that the actual engine output power is estimated from the actual mass flow rate of the intake air.

28. An engine controller, for controlling an engine condition adjusting device in an engine in consideration of an actual engine condition measured by an engine condition measuring sensor, comprising, an interface device for generating an input signal corresponding to a desired engine condition, and an instruction signal generator for determining an instruction signal to be input to the engine condition adjusting device for controlling an operation degree of the engine condition adjusting device on the basis of a comparison between the input signal and an actual engine condition signal corresponding to the actual engine condition so that a difference between the desired engine condition and the measured actual engine condition is decreased, wherein, the instruction signal for controlling the engine condition adjusting device is determined on the basis of the comparison between the input signal and the actual engine condition signal when normalities of the interface device, the engine condition changing device and the engine condition measuring sensor are detected, and is determined on the basis of the input signal while preventing the instruction signal from being determined on the basis of the comparison between the input signal and the actual engine condition signal when an abnormality of at least one of the interface device, the engine condition changing device and the engine condition measuring sensor is detected, wherein the instruction signal for controlling the engine condition adjusting device is determined on the basis of the comparison between the input signal and the actual engine condition signal when normalities of the interface device, the engine condition changing device and the engine condition measuring sensor are detected, and is determined on the basis of the input signal while preventing the instruction signal from being determined on the basis of the comparison between the input signal and the actual engine condition signal when an abnormality of at least one of the interface device, the engine condition changing device and the engine condition measuring sensor is detected, wherein the instruction signal for controlling the engine condition adjusting device is determined on the basis of the comparison between the input signal corresponding to a desired engine output torque and the actual engine condition signal corresponding to an actual engine output torque when a normality of a torque sensor of the engine condition measuring sensor is detected, and is determined on the basis of the input signal corresponding to a desired engine output power while preventing the instruction signal from being determined on the basis of the comparison between the input signal corresponding to the desired engine output torque and the actual engine condition signal corresponding to the actual engine output torque when an abnormality of the engine condition measuring sensor for measuring the actual engine output torque is detected.

29. An engine controller for controlling an engine condition adjusting device in an engine in consideration of an actual engine condition measured by an engine condition measuring sensor, comprising, an interface device for generating an input signal corresponding to a desired engine condition, and an instruction signal generator for determining an instruction signal to be input to the engine condition adjusting device for controlling an operation degree of the engine condition adjusting device on the basis of a comparison between the input signal and an actual engine condition signal corresponding to the actual engine condition so that a difference between the desired engine condition and the measured actual engine condition is decreased, wherein, the instruction signal for controlling the engine condition adjusting device is determined on the basis of the comparison between the input signal and the actual engine condition signal when normalities of the interface device, the engine condition changing device and the engine condition measuring sensor are detected, and is determined on the basis of the input signal while preventing the instruction signal from being determined on the basis of the comparison between the input signal and the actual engine condition signal when an abnormality of at least one of the interface device, the engine condition changing device and the engine condition measuring sensor is detected, wherein, at least one of a prevention of forming a lean fuel air mixture, a decrease of an upper limit of an injection rate of a fuel to be injected into the engine, a decrease of an upper limit of an opening degree of a throttle as the engine condition adjusting device, a close of the throttle and a prevention of supplying an electric current to the throttle is carried out in response to the abnormality of the at least one of the interface device, the engine condition changing device and the engine condition measuring sensor is detected.

30. An engine controller according to claim 29, wherein which is selected to be carried out from the prevention of forming the lean fuel air mixture, the decrease of the upper limit of the injection rate of the fuel to be injected into the engine, the decrease of the upper limit of the opening degree of the throttle, the close of the throttle and the prevention of supplying the electric current to the throttle is determined in accordance with a degree of the abnormality of the at least one of the interface device, the engine condition changing and the engine condition measuring sensor.

31. An engine controller for controlling an engine condition adjusting device in an engine in consideration of an actual engine condition measured by an engine condition measuring sensor, comprising, an interface device for generating an input signal corresponding to a desired engine condition, and an instruction signal generator for determining an instruction signal to be input to the engine condition adjusting device for controlling an operation degree of the engine condition adjusting device on the basis of a comparison between the input signal and an actual engine condition signal corresponding to the actual engine condition so that a difference between the desired engine condition and the measured actual engine condition is decreased, wherein, the instruction signal for controlling the engine condition adjusting device is determined on the basis of the comparison between the input signal and the actual engine condition signal when normalities of the interface device, the engine condition changing device and the engine condition measuring sensor are detected, and is determined on the basis of the input signal while preventing the instruction signal from being determined on the basis of the comparison between the input signal and the actual engine condition signal when an abnormality of at least one of the interface device, the engine condition changing device and the engine condition measuring sensor is detected, wherein, the abnormality of the engine condition changing device is detected when an electric current supplied to an electrically controlled throttle of the engine condition changing device and a desired opening degree of the throttle is kept is kept more than a predetermined level for a time period more than a predetermined time period.

32. An engine controller for controlling an engine condition adjusting device in an engine in consideration of an actual engine condition measured by an engine condition measuring sensor, comprising, an interface device for generating an input signal corresponding to a desired engine condition, and an instruction signal generator for determining an instruction signal to be input to the engine condition adjusting device for controlling an operation degree of the engine condition adjusting device on the basis of a comparison between the input signal and an actual engine condition signal corresponding to the actual engine condition so that a difference between the desired engine condition and the measured actual engine condition is decreased, wherein, the instruction signal for controlling the engine condition adjusting device is determined on the basis of the comparison between the input signal and the actual engine condition signal when normalities of the interface device, the engine condition changing device and the engine condition measuring sensor are detected, and is determined on the basis of the input signal while preventing the instruction signal from being determined on the basis of the comparison between the input signal and the actual engine condition signal when an abnormality of at least one of the interface device, the engine condition changing device and the engine condition measuring sensor is detected, wherein, the abnormality of the engine condition changing device is detected when an electric current supplied to an electrically controlled throttle of the engine condition changing device is kept more than a predetermined level for a time period more than a predetermined time period.

33. An engine controller for controlling an engine condition adjusting device in an engine in consideration of an actual engine condition measured by an engine condition measuring sensor, comprising, an interface device for generating an input signal corresponding to a desired engine condition, and an instruction signal generator for determining an instruction signal to be input to the engine condition adjusting device for controlling an operation degree of the engine condition adjusting device on the basis of a comparison between the input signal and an actual engine condition signal corresponding to the actual engine condition so that a difference between the desired engine condition and the measured actual engine condition is decreased, wherein, the instruction signal for controlling the engine condition adjusting device is determined on the basis of the comparison between the input signal and the actual engine condition signal when normalities of the interface device, the engine condition changing device and the engine condition measuring sensors are detected, and is determined on the basis of the input signal while preventing the instruction signal from being determined on the basis of the comparison between the input signal and the actual engine condition signal when an abnormality of at least one of the interface device, the engine condition changing device and the engine condition measuring sensor is detected, wherein, the abnormality of the engine condition measuring sensor is detected when a magnitude of the actual engine condition signal corresponding to an actual mass flow rate of an intake air to be taken into the engine is in a range other than a predetermined range.

34. An engine controller for controlling an engine condition adjusting device in an engine in consideration of an actual engine condition measured by an engine condition measuring sensor, comprising, an interface device for generating an input signal corresponding to a desired engine condition, and an instruction signal generator for determining an instruction signal to be input to the engine condition adjusting device for controlling an operation degree of the engine condition adjusting device on the basis of a comparison between the input signal and an actual engine condition signal corresponding to the actual engine condition so that a difference between the desired engine condition and the measured actual engine condition is decreased, wherein, the instruction signal for controlling the engine condition adjusting device is determined on the basis of the comparison between the input signal and the actual engine condition signal when normalities of the interface device, the engine condition changing device and the engine condition measuring sensor are detected, and is determined on the basis of the input signal while preventing the instruction signal from being determined on the basis of the comparison between the input signal and the actual engine condition signal when an abnormality of at least one of the interface device, the engine condition changing device and the engine condition measuring sensor is detected, wherein, the abnormality of the engine condition measuring sensor is detected with a difference between the actual engine condition signals which are generated by a plurality of the engine condition measuring sensors and correspond respectively to actual mass flow rates of an intake air to be taken into the engine is more than a predetermined level.

35. An engine controller for controlling an engine condition adjusting device in an engine in consideration of an actual engine condition measured by an engine condition measuring sensor, comprising, an interface device for generating an input signal corresponding to a desired engine condition, and an instruction signal generator for determining an instruction signal to be input to the engine condition adjusting device for controlling an operation degree of the engine condition adjusting device on the basis of a comparison between the input signal and an actual engine condition signal corresponding to the actual engine condition so that a difference between the desired engine condition and the measured actual engine condition is decreased, wherein, the instruction signal for controlling the engine condition adjusting device is determined on the basis of the comparison between the input signal and the actual engine condition signal when normalities of the interface device, the engine condition changing device and the engine condition measuring sensor are detected, and it is determined on the basis of the input signal while preventing instruction signal from being determined on the basis of the comparison between the input signal and the actual engine condition signal when an abnormality of at least one of the interface device, the engine condition changing device and the engine condition measuring sensor is detected, wherein, the abnormality of the engine condition measuring sensor is detected when a difference between the actual engine condition signals which are generated by a plurality of the engine condition measuring sensors and correspond respectively to actual mass flow rates of an intake air to be taken into the engine is more than a predetermined level.

36. An engine controller for controlling an engine condition adjusting device in an engine in consideration of an actual engine condition measured by an engine condition measuring sensor, comprising, an interface for generating an input signal corresponding to a desired engine condition, and an instruction signal generator for determining an instruction signal to be input to the engine condition adjusting device for controlling an operation degree of the engine condition adjusting device on the basis of a comparison between the input signal and an actual engine condition signal corresponding to the actual engine condition so that a difference between the desired engine condition and the measured actual engine condition is decreased, wherein, the instruction signal for controlling the engine condition adjusting device is determined on the basis of the comparison between the input signal and the actual engine condition signal when normalities of the interface device, the engine condition changing device and the engine condition measuring sensor are detected, and it is determined on the basis of the input signal while preventing the instruction signal from being determined on the basis of the comparison between the input signal and the actual engine condition signal when an abnormality of at least one of the interface device, the engine condition changing device and the engine condition measuring sensor is detected, wherein, the abnormality of the engine condition changing device is detected when a difference between the input signal and the actual engine condition signal is more than a predetermined level.

37. A controller for controlling an apparatus condition adjusting device in an apparatus in consideration of an actual apparatus condition measured by an apparatus condition measuring sensor, comprising, an interface device for generating an input signal corresponding to a desired apparatus condition, and an instruction signal generator for determining an instruction signal to be input to the engine condition adjusting device for controlling an operation degree of the apparatus condition adjusting device on the basis of a comparison between the input signal and an actual apparatus condition signal corresponding to the actual apparatus condition so that a difference between the desired apparatus condition and the measured actual apparatus condition is minimized, wherein the instruction signal for controlling the apparatus condition adjusting device is determined on the basis of the comparison between the input signal and the actual apparatus condition signal when a normality of at least one of the interface device, the apparatus condition changing device and the apparatus condition measuring sensor is detected, and is determined on the basis of the input signal while preventing the instruction signal from being determined on the basis of the comparison between the input signal and the actual apparatus condition signal when an abnormality of at least one of the apparatus condition changing device and the apparatus condition measuring sensor is detected, the apparatus condition adjusting device is at least one of a throttle valve and fuel injector, and the apparatus condition measuring sensor is at least one of an intake air mass flow meter and an engine output torque sensor.

38. A controller according to claim 37, wherein the apparatus condition adjusting device is a fuel-air supply device.

39. A controller according to claim 38, wherein the fuel-air supply device includes at least one of a throttle valve and fuel injector.

40. A controller according to claim 37, wherein the apparatus condition measuring device includes at least one of an intake air mass low meter and an engine output torque sensor.

* * * * *